US008459783B2

(12) United States Patent
Hirai et al.

(10) Patent No.: US 8,459,783 B2
(45) **Date of Patent: *Jun. 11, 2013**

(54) LIQUID EJECTING HEAD AND LIQUID EJECTING APPARATUS

(75) Inventors: Eiju Hirai, Okaya (JP); Hiroshi Ito, Suwa (JP); Toshihiro Shimizu, Fujimi-machi (JP); Jiro Kato, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 69 days.

This patent is subject to a terminal disclaimer.

(21) Appl. No.: 13/178,378

(22) Filed: Jul. 7, 2011

(65) Prior Publication Data

US 2012/0007929 A1 Jan. 12, 2012

(30) Foreign Application Priority Data

Jul. 8, 2010 (JP) ..... 2010-155994

(51) Int. Cl.
*B41J 2/045* (2006.01)

(52) U.S. Cl.
USPC ..... 347/71

(58) Field of Classification Search
USPC ..... 347/68–69, 70–72
See application file for complete search history.

(56) References Cited

U.S. PATENT DOCUMENTS 8,262,203 B2 * 9/2012 Hirai et al. ..... 347/71
2009/0284568 A1 11/2009 Yazaki

FOREIGN PATENT DOCUMENTS

JP 2009172878 8/2009

* cited by examiner

*Primary Examiner* — Kristal Feggins
(74) *Attorney, Agent, or Firm* — Workman Nydegger

(57) ABSTRACT

A liquid ejecting head comprising: a pressure chamber substrate where pressure chambers that communicates with nozzle holes are provided, and a piezoelectric element including a first conductive layer, a piezoelectric material layer, and a second conductive layer, wherein the piezoelectric element has an overlap area that overlaps the pressure chamber, the first conductive layer, the piezoelectric material layer, and the second conductive layer, wherein the second conductive layers overlap a plurality of the pressure chambers continuously, wherein, the first conductive layer is provided in each of the overlap areas and has an end portion area at one end side of the overlap area in the longitudinal direction, and wherein a width of the end portion area gets narrow in the lateral direction as the end portion area directs to the end of the longitudinal direction.

14 Claims, 14 Drawing Sheets

LIQUID EJECTING HEAD AND LIQUID EJECTING APPARATUS

This application claims a priority to Japanese Patent Application No. 2010-155994 filed on Jul. 8, 2010 which is hereby expressly incorporated by reference herein in its entirety.

BACKGROUND

1. Technical Field

The present invention relates to a liquid ejecting head and a liquid ejecting apparatus.

2. Related Art

The liquid ejecting head including a piezoelectric element is known for ejecting the liquid droplet of ink or the like for example, in the liquid ejecting apparatus of an ink jet printer. The liquid ejecting head is provided such that for example, the piezoelectric element deforms a vibration plate according to a driving signal and then pressure within a pressure chamber that is formed lower side of the vibration plate can be changed. Accordingly, the liquid droplet of the ink or the like that is supplied within the pressure chamber can be ejected from the nozzle holes. In the liquid ejecting head, as an object for protecting a piezoelectric material layer of the piezoelectric element that is weak with respect to the destruction for example, by external factors such as moisture or the like, there is a structure in which the piezoelectric material layer is covered by an upper electrode (for example, JP-A-2009-172878 (FIG. 2)).

However, if the piezoelectric element described in JP-A-2009-172878 is driven, since an electric field is applied inside of a boundary of an active region that is defined at an area where the upper electrode and the lower electrode sandwiches and overlaps the piezoelectric material layer, the piezoelectric material layer of the piezoelectric element generates a displacement as the piezoelectric material, and since the electric field is not applied outside thereof, piezoelectric element does not generate the displacement as the piezoelectric material. Thus, there is a problem that concentration of local strain is generated near of boundary of the active region and then crack is easily caused at the piezoelectric material layer.

SUMMARY

An advantage of some aspects of the invention is that it provides a liquid ejecting head and a liquid ejecting apparatus in which the generation of the crack is suppressed and then durability is enhanced.

1. A liquid ejecting head including: a pressure chamber substrate where a plurality of pressure chambers that communicates with nozzle hole respectively is provided; and a piezoelectric element including a first conductive layer, a piezoelectric material layer and a second conductive layer which are provided in this order toward upper side of the pressure chamber substrate; wherein the piezoelectric element has an overlap area that overlaps the pressure chamber, the first conductive layer, the piezoelectric material layer and the second conductive layer as seen from a plan view, wherein the second conductive layers overlap a plurality of the pressure chambers and are provided continuously as seen from the plan view, wherein, the first conductive layer is provided in each of the overlap areas in which a first direction is a longitudinal direction of the first conductive layer and a second direction that is orthogonal to the first direction is lateral direction of the first conductive layer, wherein, the first conductive layer has an end portion area at least one end side of the overlap area in the first direction, and wherein, a width of the end portion area is narrowed in the second direction as the end portion area directs to the end of the first direction.

In the invention, a term of "upper side" is used as for example, "one specific thing (refers to as A, in below) is formed upper side of the other specific thing (refers to as B, in below)", or the like. In the description according to the embodiments, "upper side" is used in such an example including a case where A is formed directly on B and a case where A is formed on B though other things. Similarly, a term of "lower side" includes a case where A is formed directly on B and a case where A is formed on B though other things.

In addition, in the invention, a case of "seen from the plan view" is a case where it is seen from the direction perpendicular to the pressure chamber substrate.

According to the invention, since the width of the end portion area of the first conductive layer is gradually narrowed in the second direction as the end portion area directs to the end of the first direction, the concentration of the local strain can be released near the boundary of the overlap area. Thus, the liquid ejecting head having enhanced durability can be realized.

2. In the liquid ejecting head, the width of the end portion area may be narrowed from both ends in the second direction as the end portion area directs to the end of the first direction.

Accordingly, the concentration of the local strain can be released near the boundary of the overlap area. Thus, the liquid ejecting head having enhanced durability can be realized.

3. In the liquid ejecting head, the first conductive layer may have end portion areas at both ends of the overlap area in the first direction.

Accordingly, the concentration of the local strain can be released at both ends near the boundary of the overlap area. In addition, a stress balance can be set easily at the both ends of the overlap area. Thus, the liquid ejecting head having enhanced durability can be realized.

4. In the liquid ejecting, the first conductive layer may be provided such that the shape of the overlap area becomes the line symmetry as seen from the plan view.

Accordingly, the stress balance can be set easily at the both ends of the overlap area. Thus, the liquid ejecting head having enhanced durability can be realized.

5. In the liquid ejecting head, the second conductive layer may have two end portions at one side and the other side of the first direction at the overlap area.

Accordingly, a stiffness balance can be set easily at the both ends of the overlap area. In addition, a crystal growth of the piezoelectric material layer can be controlled easily and the stiffness of the piezoelectric material layer becomes stable during manufacturing process. Thus, the liquid ejecting head having enhanced durability can be realized.

6. In the liquid ejecting head, the second conductive layer may have extension portions which extend from at least a portion of an area that is sandwiched between adjacent the overlap areas in both sides of the first direction as seen from the plan view.

Accordingly, a stiffness balance can be set further easily at the both ends of the overlap area. Thus, the liquid ejecting head having enhanced durability can be realized.

7. The liquid ejecting head further including: a first solid layer and a second solid layer that are provided on the second conductive layer, the first solid layer may be provided so as to overlap the overlap area at one end side of the overlap area in the first direction as seen from the plan view, and the second solid layer may be provided so as to overlap the overlap area at the other end side of the overlap area in the first direction as seen from the plan view.

Accordingly, a displacement amount of the piezoelectric element can be restrained. Thus, the liquid ejecting head having enhanced durability can be realized.

8. A liquid ejecting apparatus including any one of the liquid ejecting heads.

Thus, according to the invention, the liquid ejecting apparatus having enhanced durability can be realized since the liquid ejecting head having enhanced durability is included.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of the invention will be described in detail. The embodiments described below does not limit contents of the invention described in claims. In addition, entire constitutions described below are not the entire essential constitution requirement of the invention.

1. Liquid Ejecting Head

Figure 1:
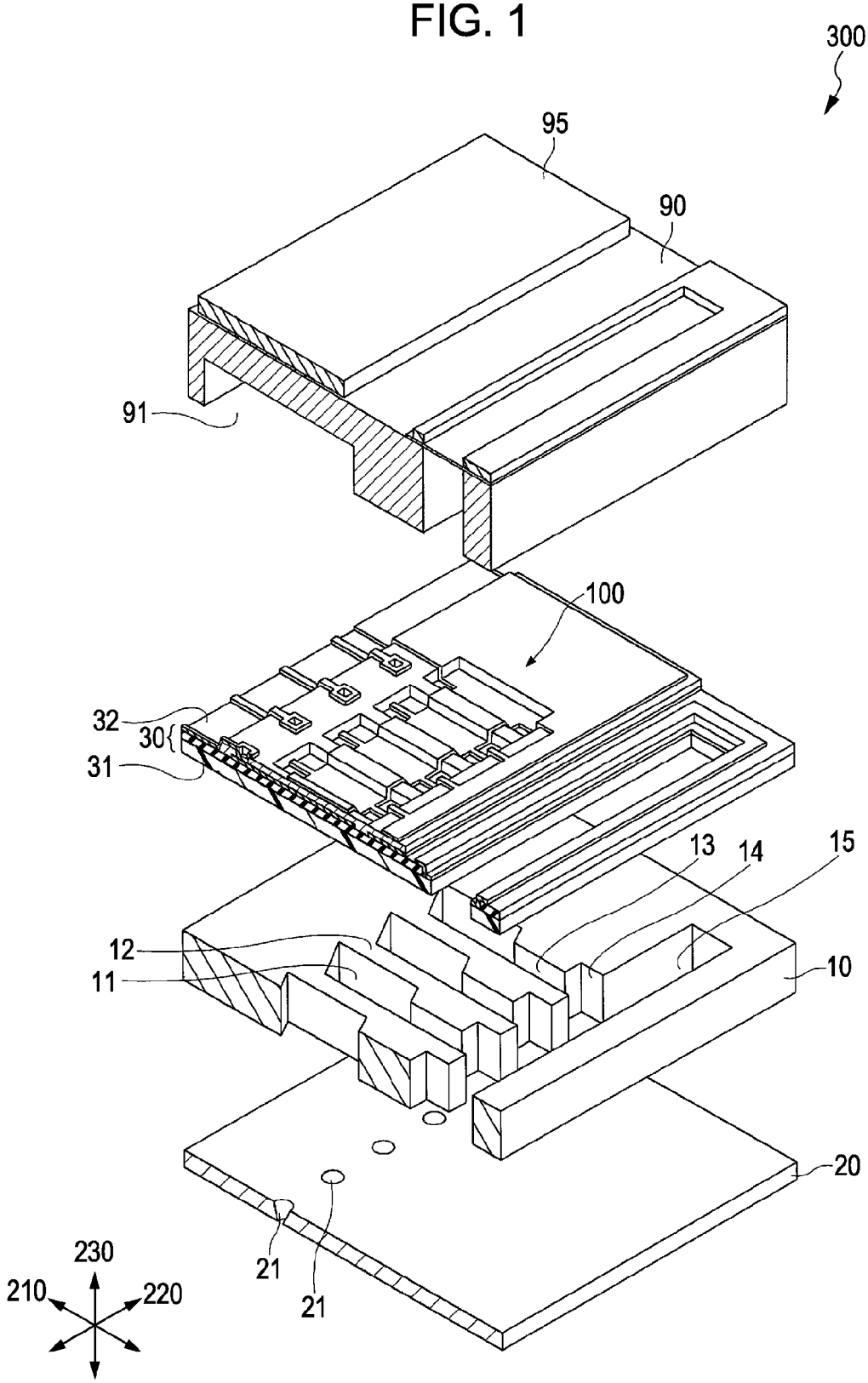
FIG. 1 is an exploded perspective view of a liquid ejecting head according to a first embodiment.

1-1. Structure of the Liquid Ejecting Head According to the First Embodiment Hereinafter, the structure of the liquid ejecting head according to the first embodiment is described below with reference to the accompanying drawings. FIG. 1 is an exploded perspective view of a liquid ejecting head 300 according to the first embodiment.

The liquid ejecting head 300 according to the first embodiment includes a pressure chamber substrate 10 in which a plurality of pressure chambers 11 that communicates with nozzle holes 21 respectively is provided and a piezoelectric element 100. In the embodiment illustrated in FIG. 1, the liquid ejecting head 300 includes the pressure chamber substrate 10, a vibration plate 30 that is formed upper side of the pressure chamber substrate 10, the piezoelectric element 100 that is formed upper side of the vibration plate 30, a nozzle plate 20 that is formed lower side of the pressure chamber substrate 10 and a sealing plate 90 that seals the piezoelectric element 100.

In the below description, a first direction 210 is a longitudinal direction of a first conductive layer 40 that is described below, a second direction 220 is orthogonal to the first direction 210 and is lateral direction of the first conductive layer 40, and a third direction 230 is orthogonal to the first direction 210 and the second direction 220 and is a normal direction of a first surface 31 of the vibration plate 30. Terms of "upper side" and "lower side" are used as the third direction 230 is in upper and lower direction. A term of "seen from the plan view" is "a case where it is seen from the direction perpendicular to the pressure chamber substrate 10", and in the below description, that is used the same that "a case where it is seen from the third direction 230".

As illustrated in FIG. 1, the pressure chamber substrate 10 has a pressure chamber 11 that communicates with the nozzle hole 21. A plurality of the pressure chambers 11 is arranged in the third direction 230 at the pressure chamber substrate 10. As illustrated in FIG. 1, the pressure chamber substrate 10 has a wall portion 12 that constitute of a sidewall of the pressure chamber 11. In addition, the pressure chamber substrate 10 may have a reservoir 15 that communicates with the pressure chamber 11 through a supply channel 13 and a communicating channel 14. A through hole (not shown) may be formed at the reservoir 15 and liquid or the like (not limited only to the liquid and materials that include various kinds of functional materials of which viscosity is adjusted properly by solvent or dispersed medium, or materials that includes metal flake or the like. Below description is the same as above) may be supplied into the reservoir 15 via the through hole from the outside. Thus, the liquid or the like is supplied into the reservoir 15 so that the liquid or the like can be supplied into the pressure chamber 11 through the supply channel 13 and the communicating channel 14. The shape of the pressure chamber 11 is not limited specifically. For example, the shape of the pressure chamber 11 may be a parallelogram or rectangular shape seen from the third direction 230. The number of the pressure chamber 11 is not limited specifically and the number thereof may be one or several. The material of the pressure chamber substrate 10 is not limited specifically. For example, the material of the pressure chamber substrate 10 may be formed of single crystal silicon, nickel, stainless, stainless steel, glass ceramics, zirconia, or various kinds of resins.

As illustrated in FIG. 1, the nozzle plate 20 is formed lower side of the pressure chamber substrate 10. The nozzle plate 20 is a plate shape member and has the nozzle hole 21. The nozzle hole 21 is formed so as to communicate with the pressure chamber 11. The shape of the nozzle hole 21 is not limited specifically if the liquid or the like can be ejected as the liquid droplet. For example, the liquid or the like within the pressure chamber 11 can be ejected toward lower side of the nozzle plate 20 through the nozzle hole 21. In addition, the number of the nozzle holes 21 is not limited specifically and the number thereof may be one or several. The material of the nozzle plate 20 is not limited specifically. For example, the nozzle plate 20 may be formed of single crystal silicon, nickel, stainless, stainless steel, glass ceramics or various kinds of resins.

As illustrated in FIG. 1, the vibration plate 30 is formed upper side of the pressure chamber substrate 10. Thus, the vibration plate 30 is formed upper side of the pressure chamber 11 and the wall portion 12. The vibration plate 30 is a plate shape member. The vibration plate 30 has the first surface 31 and a second surface 32 that faces (rear surface if the first surface 31 is front surface) the first surface 31, and covers the pressure chamber substrate 10 with the first surface 31. The structure and the material of the vibration plate 30 are not limited specifically. For example, as illustrated in FIG. 1, the vibration plate 30 may be formed by a laminated layer of a plurality of films. At this time, the vibration plate 30 may be the laminated layer of a plurality of films constituted of for example, an insulated film such as zirconia or oxidized silicon, a metal film such as nickel and a polymeric material film such as polyimide. In addition, the first conductive layer 40 (described below) of the piezoelectric element 100 may be served as the vibration plate 30. The vibration plate 30 constitutes of a vibration portion. In other words, the piezoelectric element 100 (described below) is displaced and then can vibrates (deforms). Thus, the volume of the pressure chamber 11 located in lower side thereof can be changed.

As illustrated in FIG. 1, the piezoelectric element 100 of the liquid ejecting head 300 according to the first embodiment is formed on the second surface 32 of the vibration plate 30. Hereinafter, the piezoelectric element 100 of the liquid ejecting head 300 according to the first embodiment is described in detail.

Figure 2A:
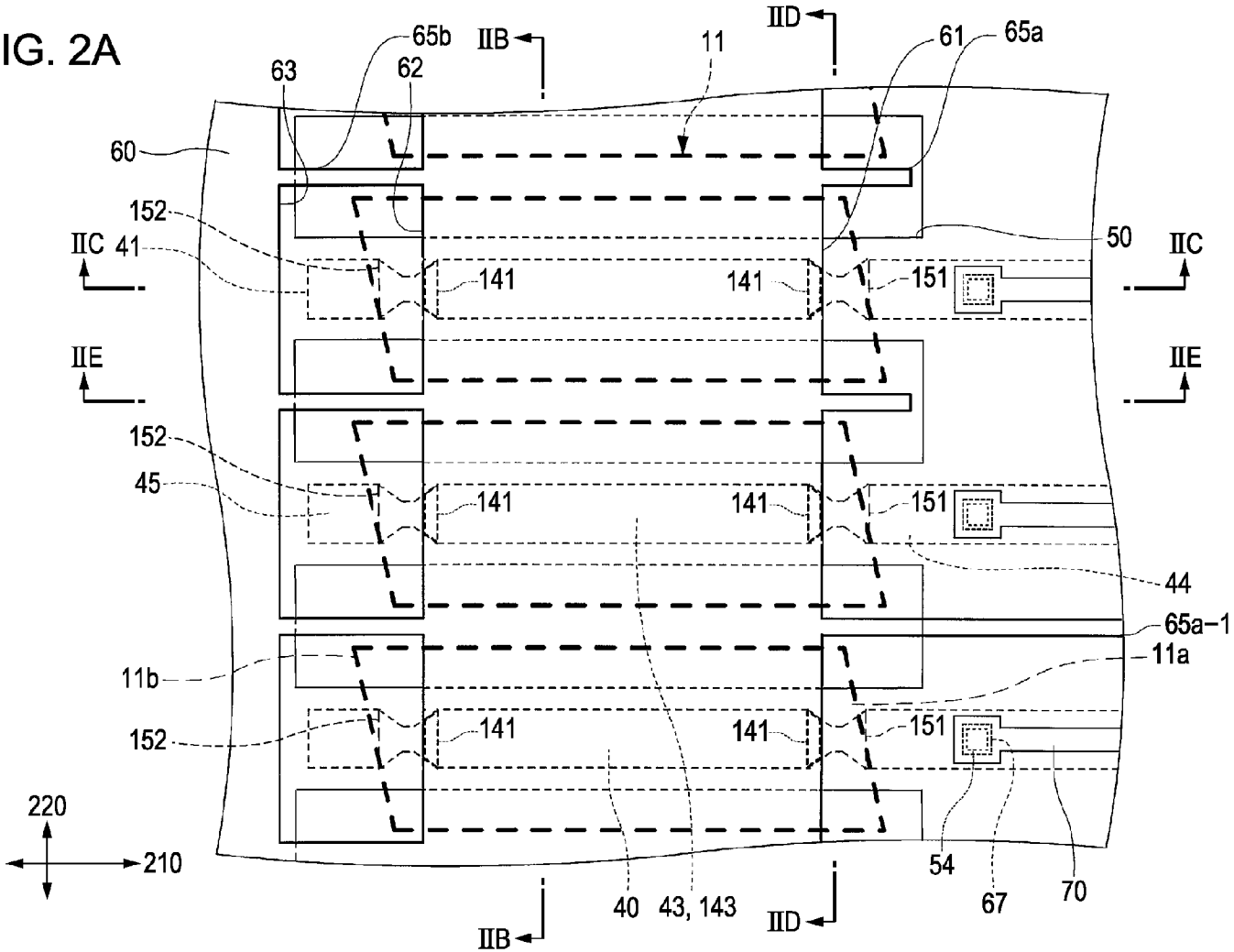
FIG. 2A is a plan view schematically showing only essential portions of the liquid ejecting head 300 according to the first embodiment.
Figure 2B:
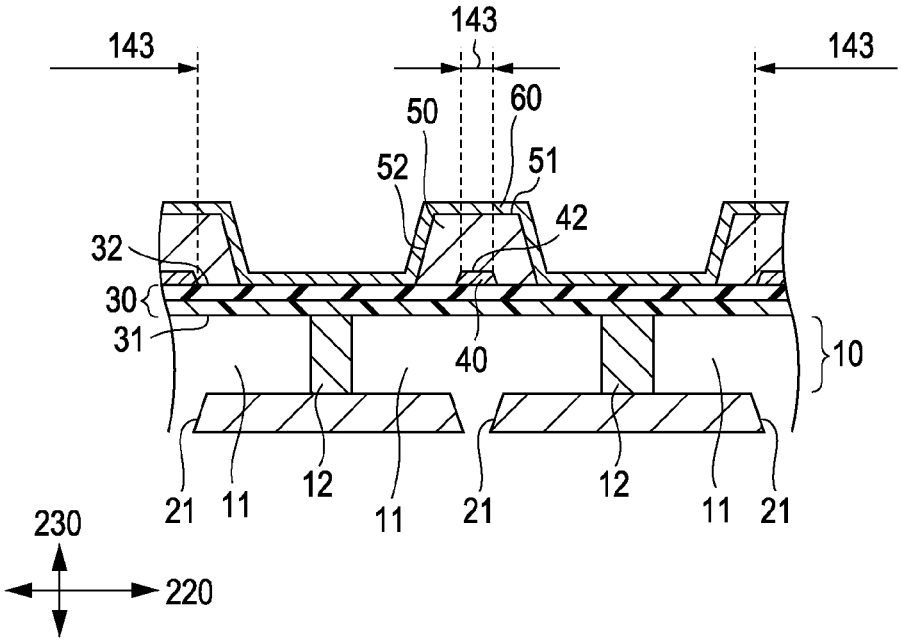
FIG. 2B is a cross sectional view taken along IIB-IIB of the essential portions in FIG. 2A.
Figure 2C:
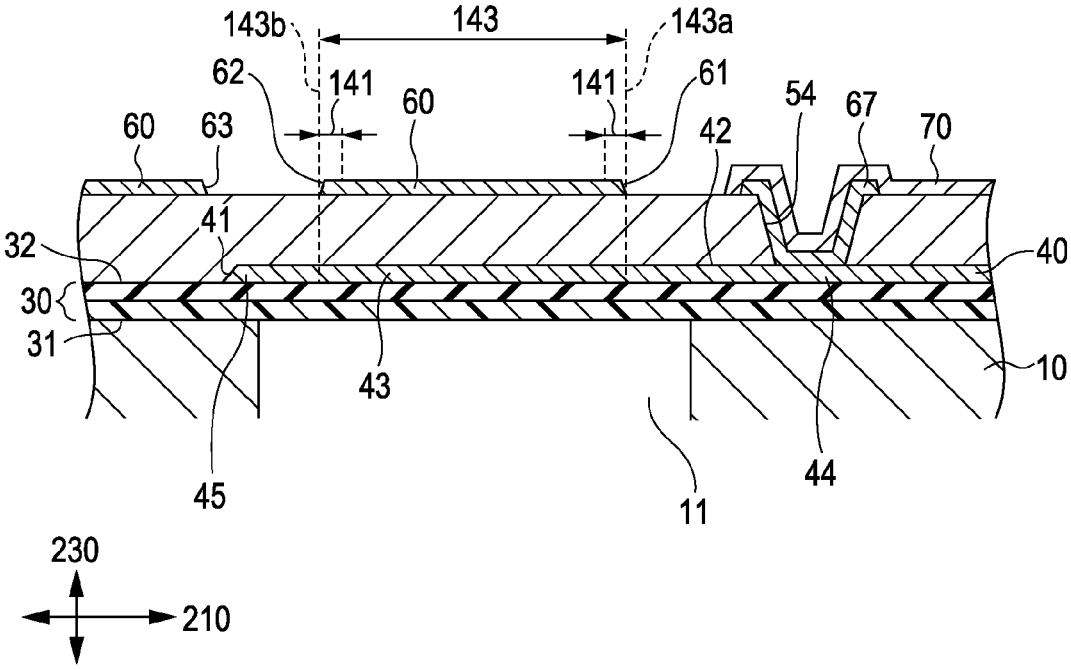
FIG. 2C is a cross sectional view taken along IIC-IIC of the essential portions in FIG. 2A.
Figure 2D:
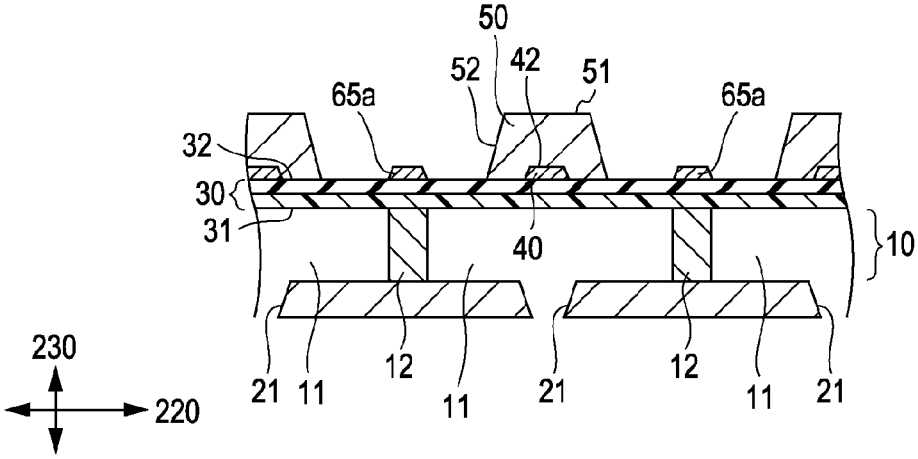
FIG. 2D is a cross sectional view taken along IID-IID of the essential portions in FIG. 2A.
Figure 2E:
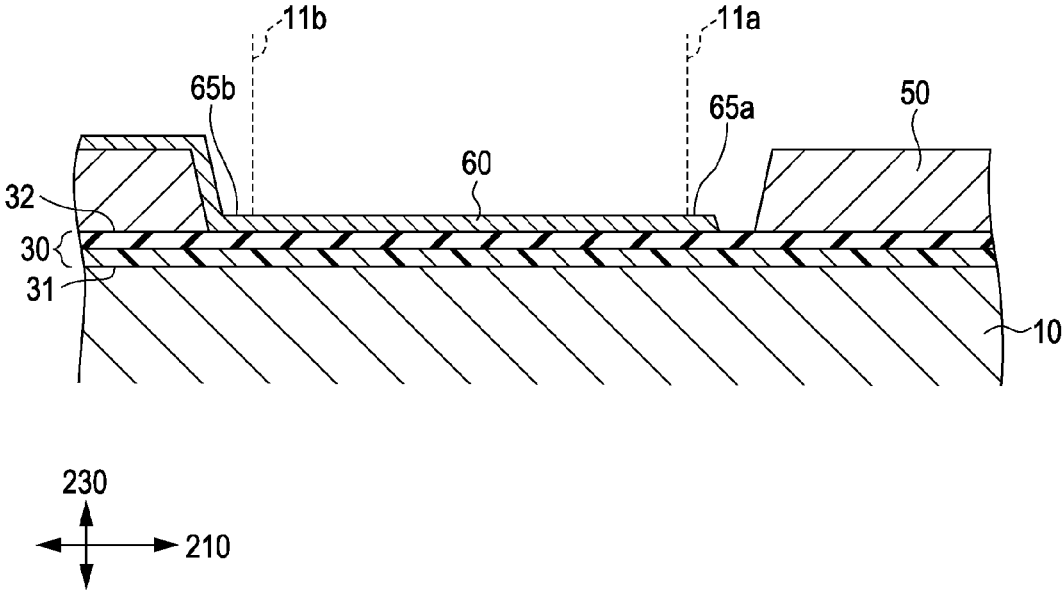
FIG. 2E is a cross sectional view taken along IIE-IIE of the essential portions in FIG. 2A.

FIG. 2A is a plan view schematically showing only the pressure chamber substrate 10, the vibration plate 30 and the piezoelectric element 100 that are essential portions of the liquid ejecting head 300 according to the first embodiment. FIG. 2B is a cross sectional view taken along IIB-IIB of the essential portions that are illustrated in FIG. 2A. FIG. 2C is a cross sectional view taken along IIC-IIC of the essential portions that are illustrated in FIG. 2A. FIG. 2D is a cross sectional view taken along IID-IID of the essential portions that are illustrated in FIG. 2A. FIG. 2E is a cross sectional view taken along IIE-IIE of the essential portions that are illustrated in FIG. 2A.

Hereinafter, the structure of the piezoelectric element 100 is described in detail. As illustrated in FIGS. 2A to 2E, the piezoelectric element 100 includes the first conductive layer 40, the piezoelectric material layer 50 and a second conductive layer 60 which are provided in this order to upper side of the pressure chamber substrate 10.

As shown in FIGS. 2A to 2C, the piezoelectric element 100 has an overlap area 143 in which the pressure chamber 11, the first conductive layer 40, the piezoelectric material layer 50 and the second conductive layer 60 are overlapped seen from the plan view.

The first conductive layer 40 has a longitudinal direction in the first direction 210 and a lateral direction in the second direction 220 perpendicular to the first direction 210 at the overlap area 143, and is provided at each of the overlap areas 143. In the embodiment illustrated in FIGS. 2A to 2C, the first conductive layer 40 is provided at each of the pressure chambers 11 so as to extend outside of an area that overlaps the pressure chamber 11 in at least one side of the first direction 210 and covers the second surface 32 of the vibration plate 30 and covers the second surface 32 of the vibration plate 30 within the area that overlaps the pressure chamber 11 in the second direction 220 as seen from the third direction 230.

As shown in FIGS. 2A and 2C, in the liquid ejecting head 300 according to the first embodiment, the first conductive layer 40 has an end surface 41 that is one side end surface in the first direction 210 at the outside of the area that overlaps the pressure chamber 11 as seen from the third direction 230. The end surface 41 is a side surface of the first conductive layer 40 in the first direction 210. The end surface 41 may be the side surface having a taper shape. Even though not illustrated in the drawings, the end surface 41 may be within the area that overlaps the pressure chamber 11 as seen from the third direction 230. As shown in FIGS. 2A and 2B, in the liquid ejecting head 300 according to the first embodiment, the first conductive layer 40 has both end portions in the second direction 220 within the area that overlaps the pressure chamber 11 as seen from the third direction 230. In addition, as shown in FIGS. 2A and 2C, in the liquid ejecting head 300 according to the first embodiment, the first conductive layer 40 has an upper surface 42.

In addition, the first conductive layer 40 has an end portion area 141 of at least one side of the overlap area 143 in the end side of the first direction 210. As the end portion area 141 directs to the end of the first direction 210, the width thereof is narrowed in the second direction 220. As the end portion area 141 directs to the end of the first direction 210, the width thereof may be narrowed from the both sides in the second direction 220.

As shown in FIG. 2A, in the liquid ejecting head 300 according to the first embodiment, as the end portion area 141 directs to the end of the first direction 210, the width thereof is narrowed simply straightly from the both sides in the second direction 220.

The piezoelectric material layer 50 of the piezoelectric element 100 generates a displacement as the piezoelectric material at the inside of a boundary of the overlap area 143 and does not generate the displacement as the piezoelectric material at the outside of the boundary of the overlap area 143 as seen from the third direction 230. Thus, locally big strain is easily concentrated near the boundary of the overlap area 143, specifically at a portion that becomes an angle of the boundary as seen from the third direction 230. In the liquid ejecting head 300 according to the first embodiment, the boundary of the overlap area 143 becomes an obtuse angle as seen from the third direction 230 so that the concentration of the local strain near the boundary of the overlap area 143 can be released. Thus, the liquid ejecting head having enhanced durability can be realized.

As shown in FIG. 2A, the first conductive layer 40 may have the end portion area 141 at the both ends of the overlap area 143 in the first direction 210. Accordingly, the concentration of the local strain can be released at the both ends near the boundary of the overlap area 143. In addition, stress balance can be set easily at the both ends of the overlap area 143. Thus, the liquid ejecting head having enhanced durability can be realized.

Furthermore, as shown in FIG. 2A, the first conductive layer 40 may be provided such that the shape of the overlap area 143 becomes line symmetry. Accordingly, stress balance can be set further easily at the both ends of the overlap area 143. Thus, the liquid ejecting head having enhanced durability can be realized.

In addition, as shown in FIGS. 2A and 2C, in the liquid ejecting head 300 according to the first embodiment, the first conductive layer 40 constitutes of a first conductive portion 43 that is provided inside of the overlap area 143, a second conductive portion 44 that is provided continuously to the first conductive portion 43 and provided outside of one side of the overlap area 143 in the first direction 210, and a third conductive portion 45 that is provided continuously to the first conductive portion 43 and provided outside of the other side of the overlap area 143 in the first direction 210 as seen from the third direction 230.

In the embodiment that is illustrated in FIG. 2A, seen from the plan view, the second conductive portion 44 that is adjacent to the end portion area 141 has a first area 151 of which the width in the second direction 220 is narrowed continuously straightly from the end portion area 141 and then widened in the second direction 220 as seen from the overlap area 143. Accordingly, the concentration of the local strain can be released while the conductivity of the first conductive layer 40 can be secured easily.

Furthermore, in the embodiment that is illustrated in FIG. 2A, seen from the plan view, the third conductive portion 45 that is adjacent to the end portion area 141 has a second area 152 of which the width in the second direction 220 is narrowed continuously straightly from the end portion area 141 and then widened in the second direction 220 as seen from the overlap area 143. Accordingly, the concentration of the local strain can be released while stiffness balance can be set easily corresponding to the first area 151.

The structure and the material of the first conductive layer 40 are not limited specifically. For example, the first conductive layer 40 may be formed of one layer. Otherwise, the first conductive layer 40 may be formed of a laminated body having a plurality of films. For example, the first conductive layer 40 may be formed of a solid layer including any one of platinum (Pt), iridium (Ir), gold (Au) and the like, or conductive oxide electrode such as $LaNiO_3$ and $SrRuO_3$. An adhesive layer may be formed between the first conductive layer 40 and the vibration plate 30 to enhance the adhesion property of these layers. For example, the adhesive layer may be formed of titanium, titanium dioxide or zirconia.

The piezoelectric material layer 50 is formed so as to cover the first conductive layer 40 within the area that overlaps at least the pressure chamber 11 as seen from the third direction 230. As shown in FIGS. 2A and 2B, in the liquid ejecting head 300 according to the first embodiment, the piezoelectric material layer 50 has both end portions within the area that overlaps the pressure chamber 11 in the second direction 220 as seen from the third direction 230. As a result, the piezoelectric material layer 50 has a width that is wider than the width of the first conductive layer 40 and narrower than the width of the pressure chamber 11 in the second direction 220. As shown in FIGS. 2A and 2C, the piezoelectric material layer 50 are formed so as to extend continuously even to the outside of the area that overlaps the pressure chamber 11 along the first direction 210 and to cover the second conductive portion 44 and the third conductive portion 45 of the first conductive layer 40 as seen from the third direction 230. The shape of the piezoelectric material layer 50 is not limited specifically, however for example, as shown in FIGS. 2A and 2B, the piezoelectric material layer 50 may have an upper surface 51 that is at the upper side of the first conductive layer 40 and a side surface 52 that has a taper shape continued to the upper surface 51. For example, as shown in FIGS. 2A and 2B, there is an area in which the piezoelectric material layer 50 is not present in at least a portion of the area that is sandwiched between adjacent the pressure chambers 11 as seen from the third direction 230.

The piezoelectric material layer 50 can be formed of polycrystalline having piezoelectric property and can be vibrated by applying the voltage in the piezoelectric element 100. The structure and the material of the piezoelectric material layer 50 are not limited specifically and may have the piezoelectric property. The piezoelectric material layer 50 may be formed of known piezoelectric materials and may use for example, lead zirconate titanate ($Pb(Zr,Ti)O_3$) and bismuth-sodium-titanate ($(Bi,Na)TiO_3$).

In addition, as shown in FIGS. 2A and 2C, the piezoelectric material layer 50 may have an opening portion 54 so as to expose a portion of the second conductive portion 44 on the second conductive portion 44 of the first conductive layer 40. The position of the opening portion 54 is not limited specifically and may have a gap with the second conductive layer 60 (described below) on the second conductive portion 44. The shape of the opening portion 54 is not limited specifically and may be good if the first conductive layer 40 that is the second conductive portion is exposed.

It is preferable that the position of the opening portion 54 does not overlap the pressure chamber 11 for securing the symmetry of the vibration plate 30. The distance thereof from the pressure chamber 11 is determined by the wiring resistance value that is permitted.

The second conductive layer 60 seen from the plan view overlaps a plurality of the pressure chambers 11 and is provided continuously. As shown in FIGS. 2A and 2B, in the liquid ejecting head 300 according to the first embodiment, the second conductive layer 60 covers the piezoelectric material layer 50 and is formed continuously at least within the area that overlaps the pressure chamber 11 in the second direction 220 as seen from the third direction 230. For example, as shown in FIGS. 2A and 2B, the second conductive layer 60 is provided continuously in the second direction 220 so as to cover a plurality of the piezoelectric material layers 50 respectively. As shown in FIGS. 2A and 2B, the second conductive layer 60 can cover continuously the upper surface 51 and the side surface 52 of the piezoelectric material layer 50 at a portion of the piezoelectric material layer 50 in the first direction 210.

In addition, the second conductive layer 60 may have two end portions 61 and 62 at the overlap area 143 in one side and the other side of the first direction 210. In other words, as shown in FIGS. 2A and 2B, the second conductive layer 60 may be provided so as to overlap a portion of the first conductive layer 40 and cover at least a portion of the piezoelectric material layer 50 at the overlap area 143 in the first direction 210. As shown in FIGS. 2A and 2C, in the liquid ejecting head 300 according to the first embodiment, the end portion 61 and the end portion 62 are arranged to overlap the upper surface 42 of the first conductive layer 40 as seen from the third direction 230. Two end portions 61 and 62 are end portions that are formed within the area that overlaps the pressure chamber 11 in the first direction 210 as seen from the third direction 230. The end portion 61 is an end portion where the end surface 41 of the first conductive layer 40 is formed and the end portion 62 is an end portion where the opening portion 54 is formed. In addition, as shown in FIGS. 2A and 2C, in the liquid ejecting head 300 according to the first embodiment, the width of the second conductive layer 60 within the area that overlap the pressure chamber 11 in the first direction 210 as seen from the third direction 230 is smaller than the width of the first conductive portion 43 of the first conductive layer 40 in the first direction 210. As shown in FIGS. 2A and 2C, an opening portion 63 where the second conductive layer 60 is not provided may be formed. The end portion 62 may forms a portion of the opening portion 63.

As shown in FIGS. 2A and 2C, in the liquid ejecting head 300 according to the first embodiment, the second conductive layer 60 is formed so that the end portion 61 and the end portion 62 overlap the upper surface 42 of the first conductive layer 40 within the area that overlaps the pressure chamber 11 as seen from the third direction 230. As shown in FIGS. 2A and 2C, the position of an end portion 143*a* of one side of the overlap area 143 in the first direction 210 can be defined by the position of the end portion 61 of the second conductive layer 60. In addition, the position of an end portion 143*b* of the other side of the overlap area 143 in the third direction 230 can be defined by the position of the end portion 62 of the second conductive layer 60. As a result, the overlap area 143 can be formed on the upper surface 42 of the first conductive portion 43 of the first conductive layer 40. In other words, the overlap area 143 is not formed on the end surface 41 the first conductive layer 40.

As described above, the second conductive layer 60 has two end portions 61 and 62 at one side and the other side of the overlap area 143 in the first direction 210 so that the stiffness balance can be set easily at the both ends of the overlap area 143. In addition, since the first conductive layer 40 is present at lower side of the piezoelectric material layer 50 that becomes the overlap area 143, crystal growth of the piezoelectric material layer 50 can be controlled easily and the stiffness of the piezoelectric material layer 50 becomes stable during manufacturing process. Thus, the liquid ejecting head having enhanced durability can be realized.

Furthermore, the second conductive layer 60 may have extension portions 65*a* and 65*b* which extend from at least a portion of the area that is sandwiched between adjacent the overlap areas 143 in both sides of the first direction 210 as seen from the third direction 230. Accordingly, stiffness balance can be set further easily at the both ends of the overlap area 143. Thus, the liquid ejecting head having enhanced durability can be realized.

As shown in FIGS. 2A and 2E, in the liquid ejecting head 300 according to the first embodiment, the extension portions 65*a* and 65*b* extend further outside than end portions (a first side 11*a* and a second side 11*b*) of the pressure chamber 11 in the first direction 210 as seen from the third direction 230. Accordingly, stiffness balance can be set further easily in the first direction 210. In the embodiment that is illustrated in FIGS. 2A and 2E, the extension portion 65*a* has a length that extends to within the area where the piezoelectric material layer 50 is not present, however may extend to the area where the piezoelectric material layer 50 overlaps.

As shown in FIGS. 2A and 2D, in the liquid ejecting head 300 according to the first embodiment, the extension portions 65*a* and 65*b* are provided at the position where the pressure chamber 11 does not overlap as seen from the third direction 230. Accordingly, the extension portions 65*a* and 65*b* are difficult to disturb the vibration of the vibration plate 30.

As shown in FIGS. 2A and 2E, in the liquid ejecting head 300 according to the first embodiment, the extension portions 65*a* and 65*b* are provided in line symmetry as the second direction 220 is a symmetry axis within the range from one end to the other end of the pressure chamber 11 in the first direction 210 as seen form the third direction 230. Accordingly, the stiffness balance is substantially set in the first direction 210 so that the liquid ejecting head having enhanced durability can be realized.

The second conductive layer 60 may be electrically connected to a common electrode (not shown) and at least a portion of the extension portions 65*a* and 65*b* may be electrically connected to the common electrode at the extension portion. In the embodiment that is illustrated in FIGS. 2A and 2E, the extension portion 65*b* is electrically connected to the common electrode at all extension portions. In addition, in the embodiment that is illustrated in FIGS. 2A and 2E, an extension portion 65*a*-1 that is a portion of the extension portion 65*a* is electrically connected to the common electrode at the extension portion. The second conductive layer 60 is electrically connected to the common electrode and at least a portion of the extension portions 65*a* and 65*b* is electrically connected to the common electrode at the extension portion so that the resistance value between the second conductive layer 60 and the common electrode can be decreased.

The structure and the material of the second conductive layer 60 are not limited specifically. For example, the second conductive layer 60 may be formed of single layer. Otherwise, the second conductive layer 60 may be formed of the laminated body having a plurality of films. The second conductive layer 60 is formed of a layer having the conductivity and constitutes an upper electrode at the piezoelectric element 100. For example, the second conductive layer 60 may be formed of the solid layer including platinum (Pt), iridium (Ir) and gold (Au). The second conductive layer 60 can cover entirely a portion that includes the overlap area 143 of the piezoelectric material layer 50 in the first direction 210. Accordingly, the piezoelectric material layer 50 of the overlap area 143 can be protected from the influence of external factors such as moisture (humidity) in the atmosphere.

As shown in FIGS. 2A and 2C, a third conductive layer 67 may be formed so as to cover at least the opening portion 54. In addition, the third conductive layer 67 may be formed so as to cover the second conductive portion 43 (the first conductive layer 40) in at least the opening portion 54 (not shown). The structure and the material of the third conductive layer 67 are not limited specifically. The third conductive layer 67 may be the layer having the conductivity or may be the same that the second conductive layer 60. The third conductive layer 67 is formed so that the surface of the second conductive portion 43 of the first conductive layer 40 in the opening portion 54 can be protected during the manufacturing process. The detailed description thereof will be given in the manufacturing method in below. Since the third conductive layer 67 is not essential constitution of the piezoelectric element 100 in the first embodiment, the third conductive layer 67 may not form on the first conductive layer 40 at the opening portion 54.

As shown in FIGS. 2A and 2C, a fourth conductive layer 70 is formed so as to electrically connect to the third conductive layer 67. As a result, the fourth conductive layer 70 is electrically connected to the first conductive portion 42 through the second conductive portion 43. The fourth conductive layer 70 may be formed so as to cover at least the opening portion 54. The shape of the fourth conductive layer 70 is not limited specifically if it is formed at least within the opening portion 54. The structure and the material of the fourth conductive layer 70 are not limited specifically. The fourth conductive layer 70 may be formed of single layer. Otherwise, the fourth conductive layer 70 may be formed of a laminated layer having a plurality of films. The fourth conductive layer 70 is formed of the layer having the conductivity and constitutes a lead wire toward a lower electrode at the piezoelectric element 100. For example, the fourth conductive layer 70 may be formed of the solid layer including gold (Au), nickel-chrome alloy (Ni—Cr), platinum (Pt), iridium (Ir), copper (Cu) and nickel (Ni). The fourth conductive layer 70 may be connected to the outside driving circuit 95. Accordingly, for example, the first conductive layer 40 can be electrically connected to the outside driving circuit 95 through the fourth conductive layer 70.

As shown in FIG. 1, the liquid ejecting head 300 according to the first embodiment may have the sealing plate 90 that can seal the piezoelectric element 100. The sealing plate 90 has a sealing area 91 that can seal the piezoelectric element 100 in a predetermined space area. The sealing area 91 may be good if the space area is some degree of not disturbing the vibration movement of the piezoelectric element 100. The structure and the material of the sealing plate 90 are not limited specifically. For example, the sealing plate 90 may be formed of single crystal silicon, nickel, stainless, stainless steel, glass ceramics or various kinds of resins. In addition, the liquid ejecting head 300 is formed of for example, various kinds of resin materials and various kinds of metal materials, and may have a case (not shown) in which above described constitutions can be accommodated.

1-2. Structure According to the Second Embodiment

Figure 3:
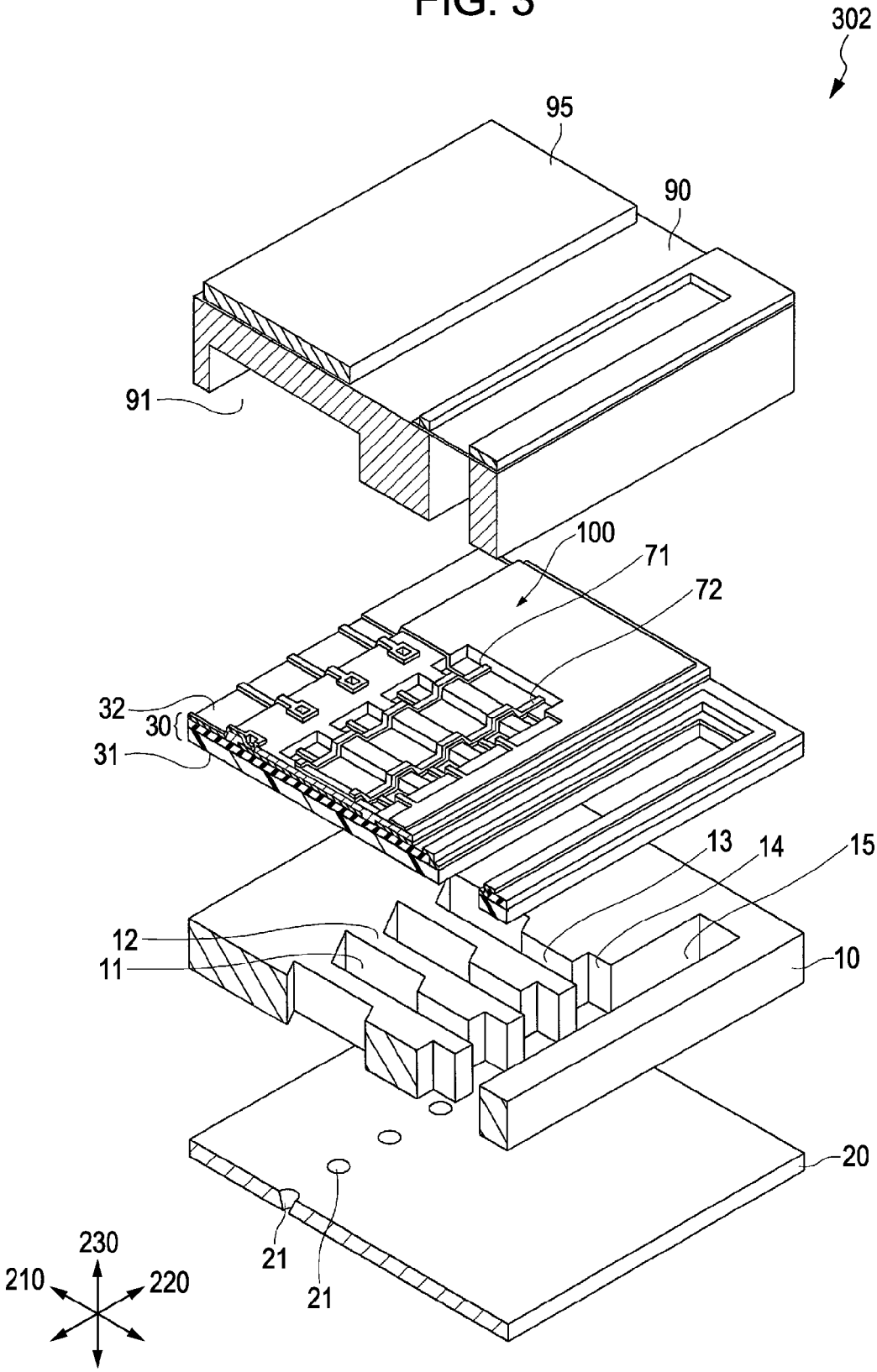
FIG. 3 is an exploded perspective view of a liquid ejecting head according to a second embodiment.
Figure 4A:
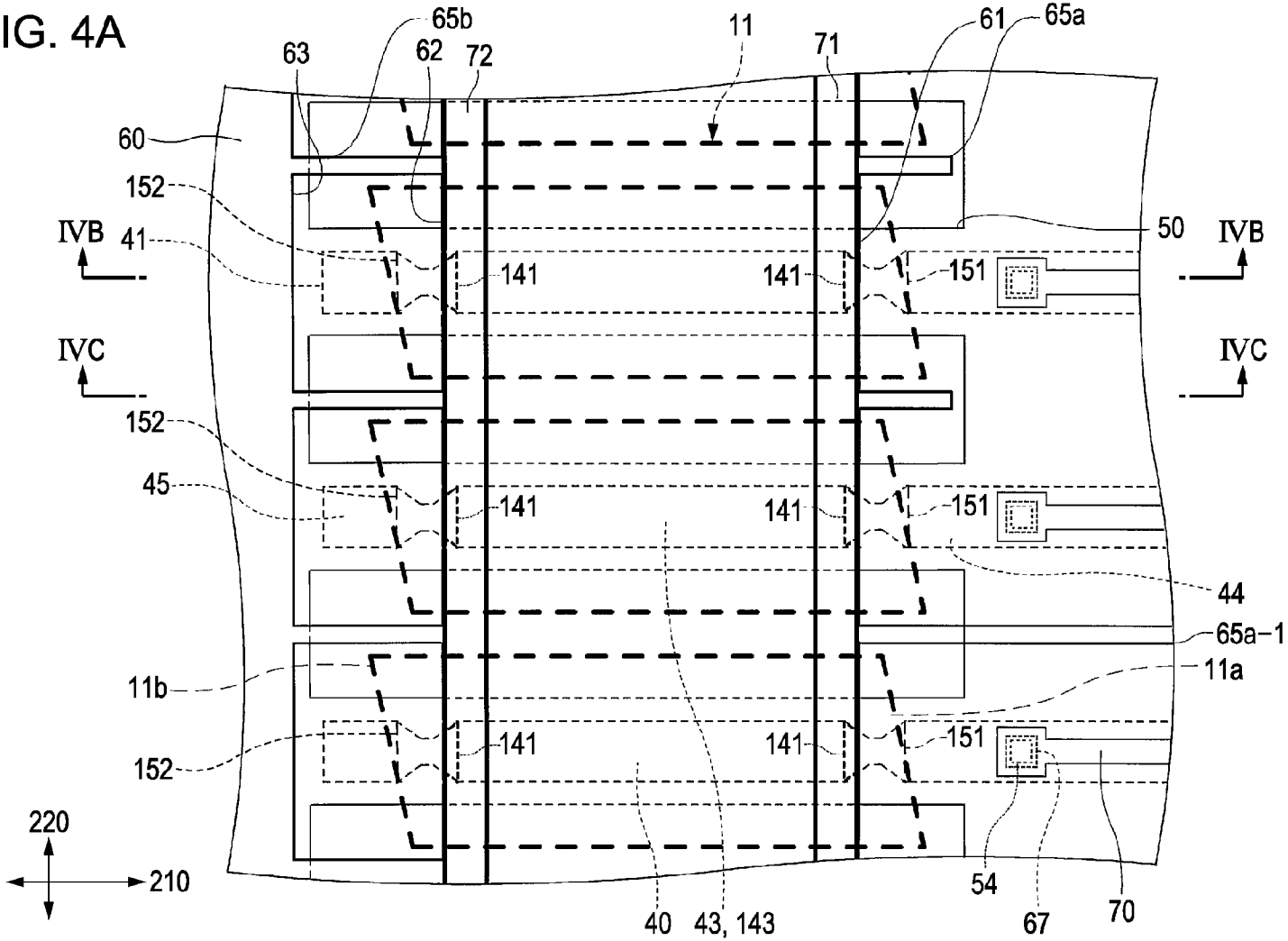
FIG. 4A is a plan view schematically showing the essential portions of the liquid ejecting head according to the second embodiment.
Figure 4B:
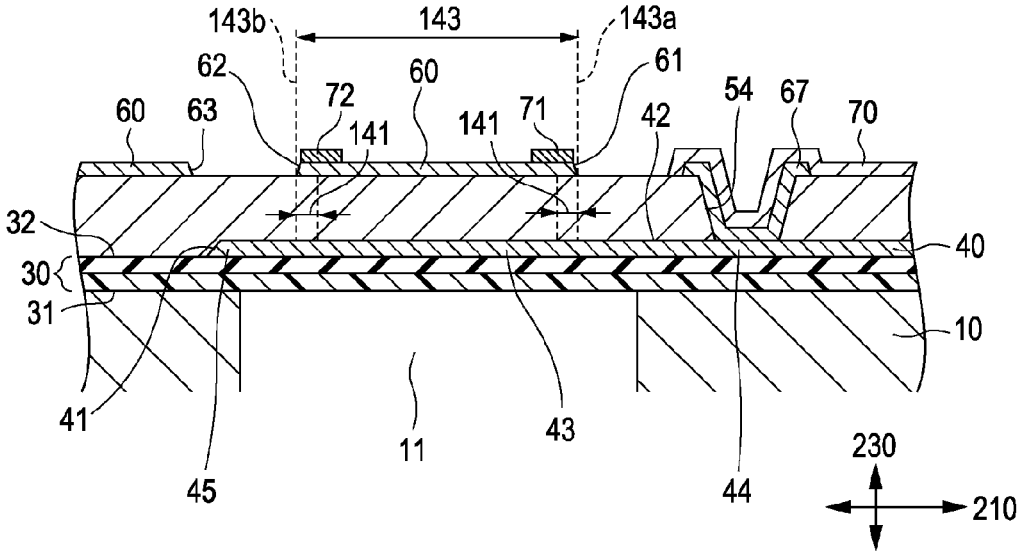
FIG. 4B is a cross sectional view taken along IVB-IVB of the essential portions in FIG. 4A.
Figure 4C:
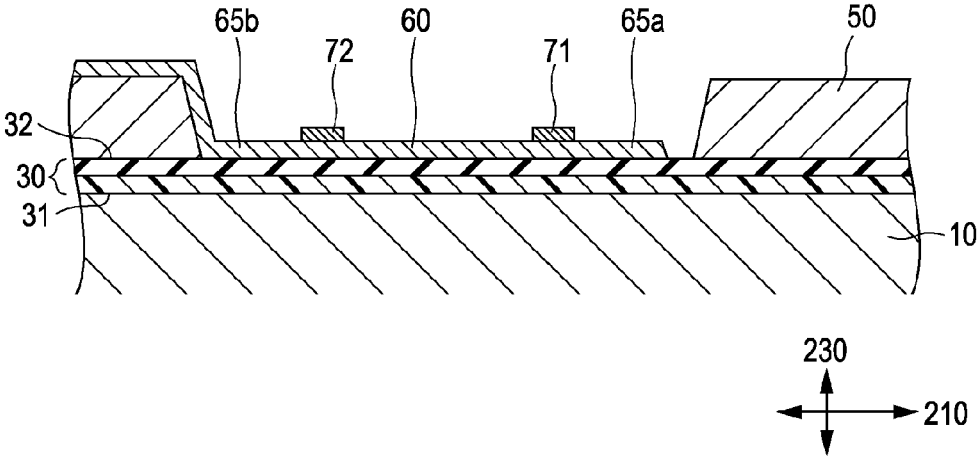
FIG. 4C is a cross sectional view taken along IVC-IVC of the essential portions in FIG. 4A.

FIG. 3 is an exploded perspective view of a liquid ejecting head 302 according to the second embodiment. FIG. 4A is a plan view schematically showing only the pressure chamber substrate 10, the vibration plate 30 and the piezoelectric element 100 that are essential portions of the liquid ejecting head 302 according to the second embodiment. FIG. 4B is a cross sectional view taken along IVB-IVB of the essential portions that are illustrated in FIG. 4A. FIG. 4C is a cross sectional view taken along IVC-IVC of the essential portions that are illustrated in FIG. 4A. In addition, the structure that is illustrated in FIGS. 2B and 2D is common to the liquid ejecting head 300 according to the first embodiment and the description thereof will be omitted.

As shown in FIGS. 3, 4A, 4B and 4C, the liquid ejecting head 302 according to the second embodiment includes a first solid layer 71 and a second solid layer 72 that are provided on the second conductive layer 60. The first solid layer 71 is provided so as to overlap the overlap area 143 at one end of the overlap area 143 in the first direction 210 as seen from the plan view and the second solid layer 72 is provided so as to overlap the overlap area 143 at the other end of the overlap area 143 in the first direction 210 as seen from the plan view.

As described above, the liquid ejecting head 302 has the first solid layer 71 and the second solid layer 72 so that the displacement amount of the piezoelectric element 100 can be restrained. Thus, the liquid ejecting head having enhanced durability can be realized.

In addition, the first solid layer 71 and the second solid layer 72 may be provided so as to overlap at least a portion of the end portion area 141 respectively. In the embodiment that is illustrated in FIGS. 3, 4A, 4B and 4C, the first solid layer 71 and the second solid layer 72 may be provided so as to overlap entire of the end portion area 141 respectively. Since such solid layers 71 and 72 are included, the liquid ejecting head having further enhanced durability can be realized.

The structure and the material of the first solid layer 71 and the second solid layer 72 are not limited specifically. For example, the first solid layer 71 and the second solid layer 72 may be formed of single layer. Otherwise, the first solid layer 71 and the second solid layer 72 may be formed of the laminated body having a plurality of films. The first solid layer 71 and the second solid layer 72 may be formed of a layer having the conductivity. If the first solid layer 71 and the second solid layer 72 are formed of the layer having the conductivity, the first solid layer 71 and the second solid layer 72 may be electrically connected to the second conductive layer 60. Since the first solid layer 71 and the second solid layer 72 are electrically connected to the second conductive layer 60, the first solid layer 71, the second solid layer 72 and the second conductive layer 60 integrally function as an electrode of the piezoelectric element 100. Thus, the resistance of the electrode of the piezoelectric element 100 can be decreased.

The first solid layer 71 and the second solid layer 72 for example, may be formed of the solid layer including gold (Au), nickel-chrome alloy (Ni—Cr), platinum (Pt), iridium (Ir), nickel (Ni), tungsten (W) and copper (Cu). The first solid layer 71 and the second solid layer 72 are preferably formed as using gold. In addition, the first solid layer 71 and the second solid layer 72 are preferably formed as using the same material that the fourth conductive layer 70. The thickness of the films of the first solid layer 71 and the second solid layer 72 may be adjusted properly.

1-3. Structure According to the Modified Embodiment

Figure 5:
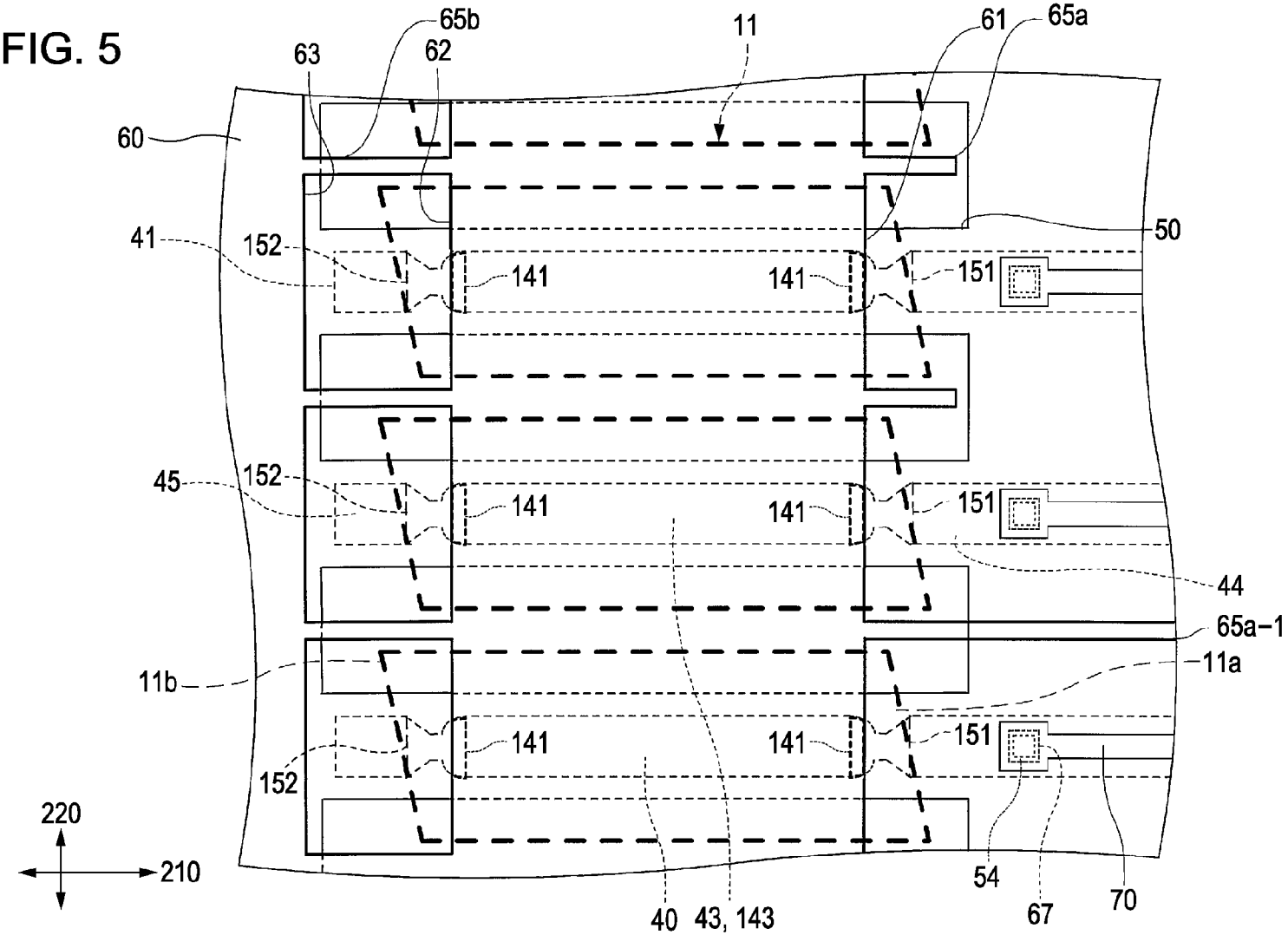
FIG. 5 is a plan view schematically showing the essential portions of the liquid ejecting head according to the modified embodiment.

The liquid ejecting head 300 according to the first embodiment and the liquid ejecting head 302 according to the second embodiment as described above can be deformed variously. An example of the modified embodiment that is applicable to the liquid ejecting head 300 according to the first embodiment and the liquid ejecting head 302 according to the second embodiment is described below. FIG. 5 is a plan view schematically showing the essential portions of the liquid ejecting head according to the modified embodiment.

As shown in FIG. 5, in the liquid ejecting head according to the modified embodiment, as the end portion area 141 of the first conductive layer 40 is directed toward ends of the first direction 210, the width in the second direction 220 is simply narrowed in a circular arc shape from both ends.

In the liquid ejecting head according to the modified embodiment that is illustrated in FIG. 5, since the boundary of the overlap area 143 becomes obtuse angle as seen from the third direction 230, the concentration of the local strain near the boundary of the overlap area 143 can be released. Thus, the liquid ejecting head having enhanced durability can be realized.

In addition, as shown in FIG. 5, the first conductive layer 40 may have the end portion area 141 at the both ends of the overlap area 143 in the first direction 210. Thus, the concentration of the local strain at the both ends of the overlap area 143 can be released. In addition, stress balance can be set easily at the both ends of the overlap area 143. Thus, the liquid ejecting head having enhanced durability can be realized.

Furthermore, as shown in FIG. 5, the first conductive layer 40 may be provided such that the shape of the overlap area 143 becomes the line symmetry. Accordingly, stress balance can be set further easily at the both ends of the overlap area 143. Thus, the liquid ejecting head having enhanced durability can be realized.

In the embodiment that is illustrated in FIG. 5, as seen from the plan view, the second conductive portion 44 that is adjacent to the end portion area 141 has the first area 151 of which the width in the second direction 220 is narrowed continuously in curve (circular arc shape) from the end portion area 141 and then widened in the second direction 220 as seen from the overlap area 143. Accordingly, the concentration of the local strain can be released while the conductivity of the first conductive layer 40 can be secured easily.

In the embodiment that is illustrated in FIG. 5, as seen from the plan view, the third conductive portion 45 that is adjacent to the end portion area 141 has the second area 152 of which the width in the second direction 220 is narrowed continuously in curve (circular arc shape) from the end portion area 141 and then widened in the second direction 220 as seen from the overlap area 143 side. Accordingly, the concentration of the local strain can be released while stiffness balance can be set easily corresponding to the first area 151.

In the above described first embodiment, second embodiment and the modified embodiment, the liquid ejecting head is described as an example of the ink jet type recording head that ejects ink, however the objects of invention are all of the liquid ejecting apparatus and the liquid ejecting head which use the piezoelectric element. The liquid ejecting heads include, for example, recording heads that is used for an image recording apparatus such as a printer or the like, a color material ejecting head that is used to manufacture a color filter of a liquid crystal display or the like, an electrode material ejecting head that is used to form an electrode of an organic EL display, a FED (Field Emission Display) or the like, a bioorganic ejecting head that is used to manufacture a biochip, and the like.

1-4. Manufacturing Method of Liquid Ejecting Head

Hereinafter, the manufacturing method of the liquid ejecting head is described below with reference to the accompanying drawings taken the liquid ejecting head 302 according to the second embodiment as an example. Even the liquid ejecting head 300 according to the first embodiment and the liquid ejecting head according to the modified embodiment can be manufactured in the same manufacturing method that the liquid ejecting head 302 according to the second embodiment.

FIGS. 6A to 11C are cross sectional views describing the manufacturing method of the liquid ejecting head 302 according to the second embodiment.

The manufacturing methods of the liquid ejecting head 302 according to the second embodiment are different between a case of using the single crystal silicon or the like and a case of using stainless or the like, in which the using materials are for forming the pressure chamber substrate 10 and the nozzle plate 20. Hereinafter, for example, the manufacturing method of the liquid ejecting head will be described in a case where the single crystal silicon is used as the material. Accordingly, even though the manufacturing method is not limited to the below description, the manufacturing method of the liquid ejecting head 302 according to the second embodiment may include a process such as known electroforming method if nickel, stainless steel, stainless or the like are used as the material. Also, before and after of each of processes are not limited the manufacturing method described below.

Figure 6A:
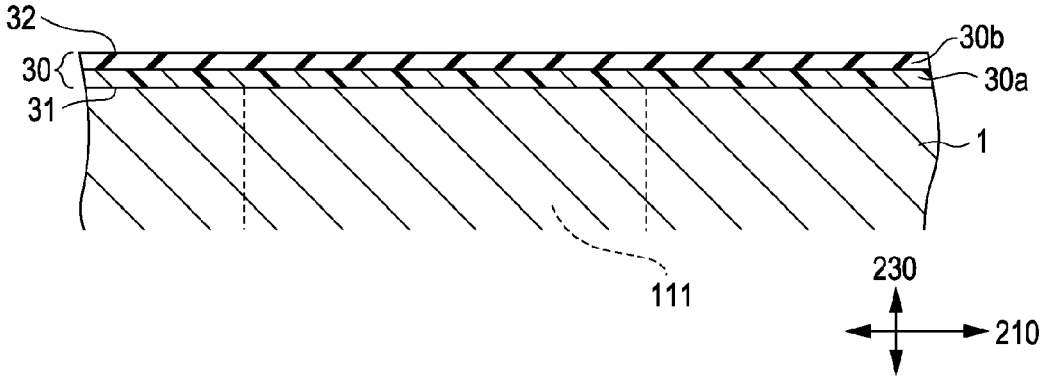
FIGS. 6A to 6C are cross sectional views describing the manufacturing method of the liquid ejecting head according to the second embodiment.

First of all, as shown in FIG. 6A, the vibration plate 30 is formed on a substrate 1 made of prepared single crystal silicon. As shown in FIG. 6A, in the manufacturing method described below, an area where the pressure chamber 11 of the substrate 1 is formed is an area 111. The vibration plate 30 is formed by known film forming technique. As shown in FIG. 6A, for example, the vibration plate 30 may be formed such that after an elastic layer 30*a* that constitutes of an elastic plate is formed by the sputtering method or the like, an insulating layer 30*b* is formed on the elastic layer 30*a* by the sputtering method or the like. For example, the elastic layer 30*a* may use zirconia and the insulating layer 30*b* may use silicon dioxide. The surface of the substrate 1 side of the vibration plate 30 refers to as the first surface 31 and the rear surface of the first surface 31 refers to as the second surface 32.

Figure 6B:
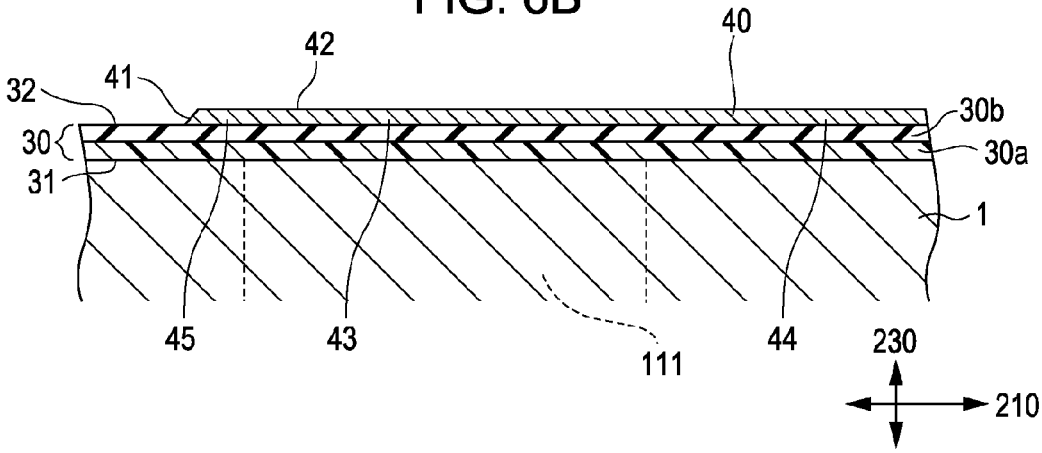

As shown in FIG. 6B, after the vibration plate 30 is formed, patterning is performed by etching and the first conductive layer 40 is formed after the conductive layer is formed on the second surface 32 of the vibration plate 30. Here, the first conductive layer 40 extends outside of an area that overlaps the area 111 at least one side of the first direction 210 so as to cover the second surface 32 of the vibration plate 30 and is patterned so as to cover the second surface 32 of the vibration plate 30 within the area that overlaps the area 111 in the second direction 220 as seen from the third direction 230. The first conductive layer 40 is patterned so as to be formed at each of the areas 111.

As shown in FIG. 6B, when the first conductive layer 40 is patterned, the end surface 41 of one side of the first conductive layer 40 in the third direction 230 is formed so as to have a side surface having a taper shape. As described above, the end surface 41 is formed. After the first conductive layer 40 is patterned, the upper surface 42 is formed simultaneously. The position of the end surface 41 may be outside of the area that overlaps the area 111 as seen from the second direction 220 and even though not shown, may be within the area that overlaps the area 111.

In addition, as shown in FIG. 4A, the first conductive layer 40 is patterned so as to have the end portion area 141 of which the width in the second direction 220 is narrowed gradually toward the end of the first direction 210 at the end side of the overlap area 143 that overlaps below described the piezoelectric material layer 50, the second conductive layer 60 and the area 111 in at least one side of the first direction 210.

In addition, detailed constitution of the first conductive layer 40 is omitted since it is described above. The first conductive layer 40 may be formed by known film forming technique. For example, the first conductive layer 40 may be formed by forming the conductive layer (not shown) by laminate platinum (Pt), iridium (Ir) or the like according to the sputtering method and etching the conductive layer to a predetermined shape.

Figure 6C:
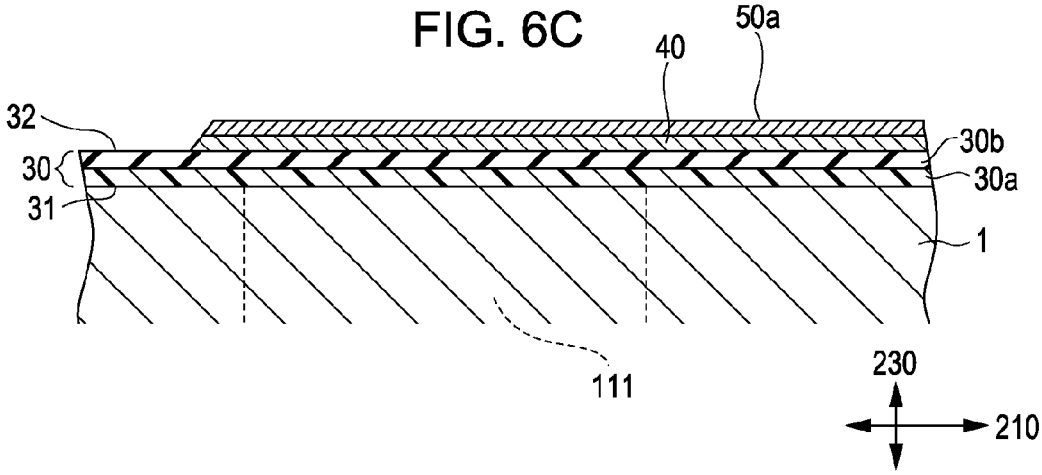

As shown in FIG. 6C, before the conductive layer is patterned by etching to form the first conductive layer 40, an etching protective film 50*a* may be formed on the conductive layer. The etching protective film 50*a* is the piezoelectric material that is formed of the same that the piezoelectric material layer 50 as below described. The etching protective film 50*a* may be formed in at least an area in which the first conductive layer 40 that is patterned in a desired shape is formed. Accordingly, the surface of the first conductive layer 40 can be protected against a chemical damage according to using etchant in the etching process in which the first conductive layer 40 is patterned.

Figure 7A:
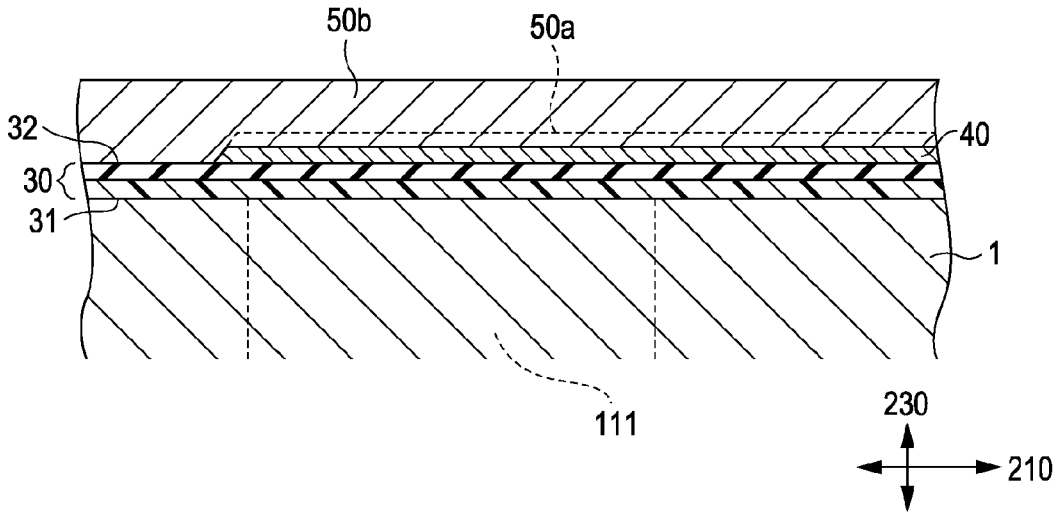
FIGS. 7A and 7B are cross sectional views describing the manufacturing method of the liquid ejecting head according to the second embodiment.

Next, as shown in FIG. 7A, a piezoelectric material layer 50*b* is formed so as to cover the first conductive layer 40. The piezoelectric material layer 50*b* is patterned and then the piezoelectric material layer 50 is formed. Detailed description thereof will be given below. The piezoelectric material layer 50*b* may be formed by known film forming technique. For example, the piezoelectric material layer 50*b* may be formed by heating the second surface 32 of the vibration plate 30 after a precursor that is known piezoelectric material coats on the second surface 32. As the using precursors, it is not limited specifically if the precursor is polarized and generates a voltage characteristic after fired by the heating process, and for example, the precursors such as lead zirconate titanate may be used. In addition, if the etching protective film 50*a* is formed, the etching protective film 50*a* can incorporate with the piezoelectric material layer 50*b* after firing since the etching protective film 50*a* is formed of the piezoelectric material that is the same that the piezoelectric material layer 50*b* (the piezoelectric material layer 50).

Figure 7B:
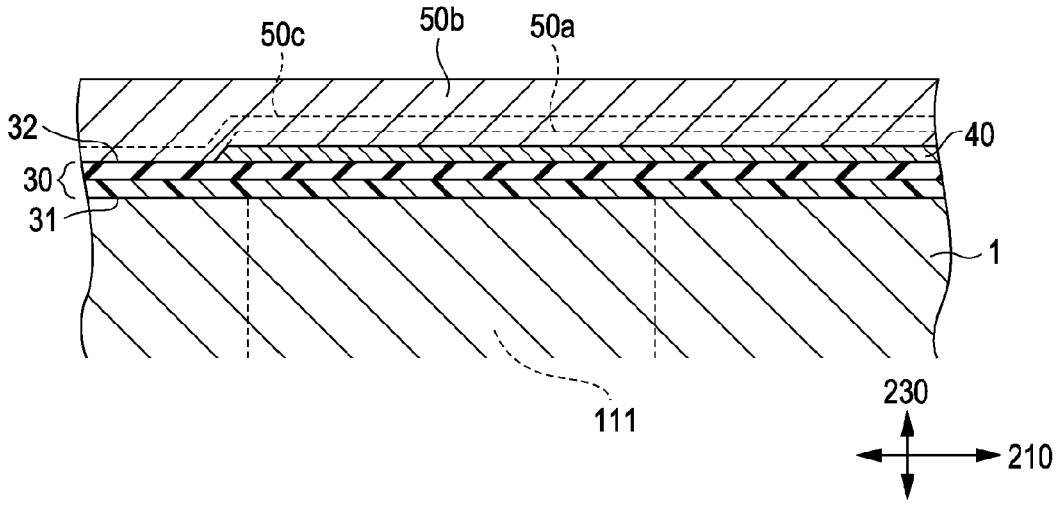

As shown in FIG. 7B, for example, if the piezoelectric material layer 50*b* (the piezoelectric material layer 50) is formed of lead zirconate titanate, the precursor that is the piezoelectric material may be coated after a middle titanium layer 50*c* that is constituted of titanium is formed at the all surface on the second surface 32 of the vibration plate 30. Accordingly, when crystal growth of the piezoelectric material layer 50*b* is performed by heating the precursor, an interface where the crystal growth of precursor is performed may be unified to the middle titanium layer 50*c*. In other words, the piezoelectric material layer 50*b* of which the crystal growth is preformed on the vibration plate 30 can be cancelled. Thus, the control of the crystal growth of the piezoelectric material layer 50*b* can be reliably performed and the piezoelectric material layer 50*b* can become piezoelectric material crystal having further high orientation property. In addition, the middle titanium layer 50*c* can enter within the crystal of the piezoelectric material layer 50*b* at the heating process.

Figure 8A:
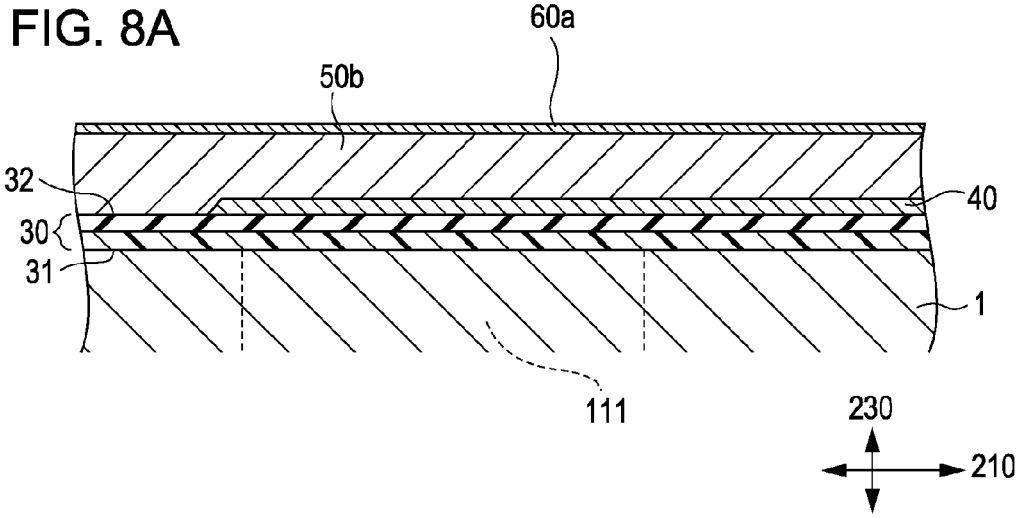
FIGS. 8A to 8C are cross sectional views describing the manufacturing method of the liquid ejecting head 302 according to the second embodiment.
Figure 8B:
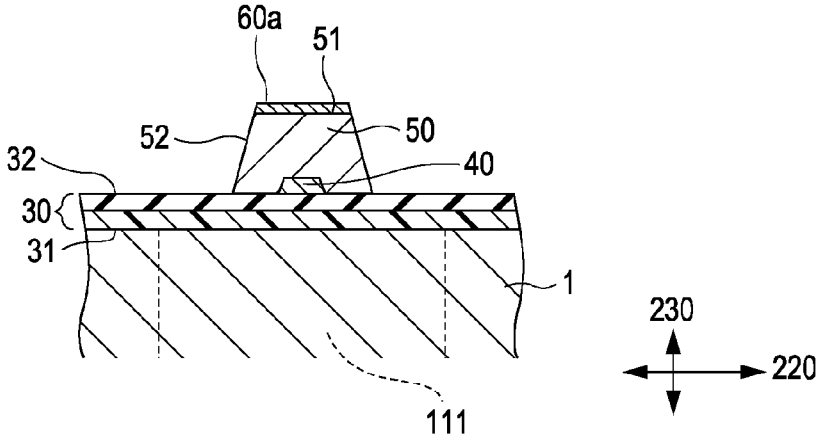

Next, as shown in FIG. 8A, before the piezoelectric material layer 50*b* is patterned to the desired shape by the etching, a mask layer 60*a* having the conductivity may be formed so as to cover the piezoelectric material layer 50*b*. The mask layer 60*a* may be formed by known film forming technique. The mask layer 60*a* may be formed by laminating for example, iridium (Ir), platinum (Pt), gold (Au), palladium (Pd), nickel (Ni) and tungsten (W) according to the sputtering method. As shown in FIG. 8B, the piezoelectric material layer 50*b* is patterned by etching and the piezoelectric material layer 50 is patterned to the desired shape after the mask layer 60*a* is formed. Since the mask layer 60*a* is functioned as a hard mask in the etching process by forming the mask layer 60*a*, the side surface 52 having the taper shape may be easily formed at the piezoelectric material layer 50 as shown in FIG. 8B. In addition, detailed constitution of the piezoelectric material layer 50 is omitted since it is described above.

Figure 8C:
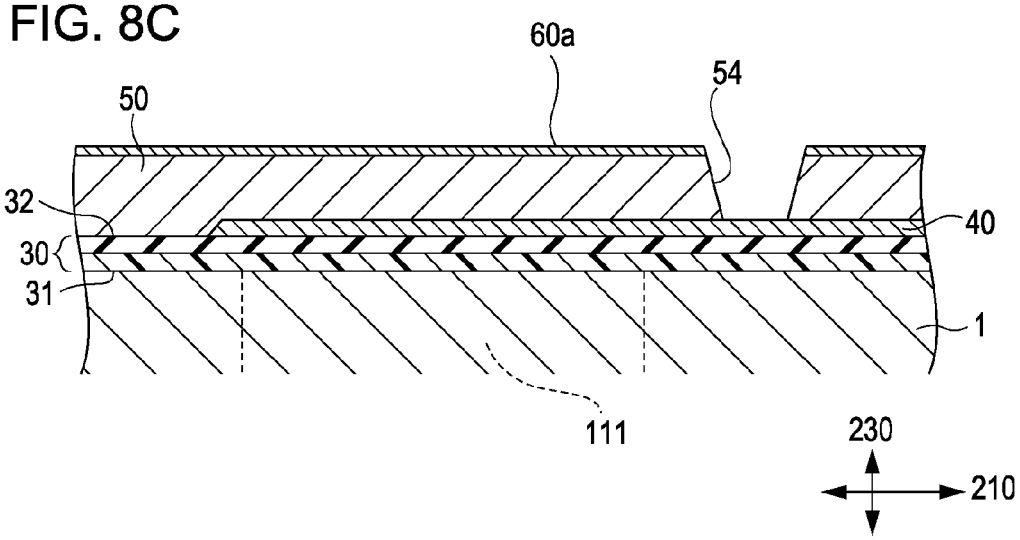

As shown in FIG. 8C, the opening portion 54 that exposes the first conductive layer 40 is simultaneously formed in the area that does not overlap the area 111 of the first conductive layer 40 when the piezoelectric material layer 50 is etched. The opening portion 54 is formed so as to separate the second conductive layer 60.

Figure 9A:
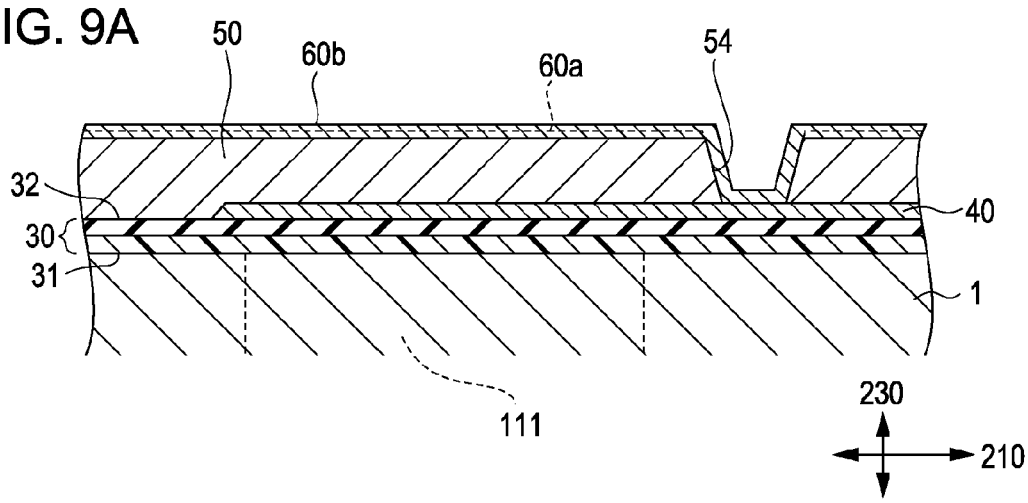
FIGS. 9A and 9B are cross sectional views describing the manufacturing method of the liquid ejecting head according to the second embodiment.

Next, as shown in FIG. 9A, a conductive layer 60*b* is formed so as to cover the piezoelectric material layer 50 and the opening portion 54. The conductive layer 60*b* may be formed by known film forming technique. The conductive layer 60*b* may be formed by laminating for example, iridium (Ir), platinum (Pt), gold (Au), palladium (Pd), nickel (Ni), tungsten (W), copper (Cu) and silver (Ag) according to the sputtering method.

If the mask layer 60*a* and the conductive layer 60*b* are formed by the same material, the mask layer 60*a* and the conductive layer 60*b* can be integrally formed. In addition, since film forming material is one type, the mask layer 60*a* and the conductive layer 60*b* can be formed with a simple process.

If the mask layer 60*a* and the conductive layer 60*b* are formed by different materials, the mask layer 60*a* may be formed of a material that is proper to assume the formation of the interface between the piezoelectric material layer 50 and the second conductive layer 60, and the conductive layer 60*b* may be formed of a material that is proper to assume the conductivity property.

Figure 9B:
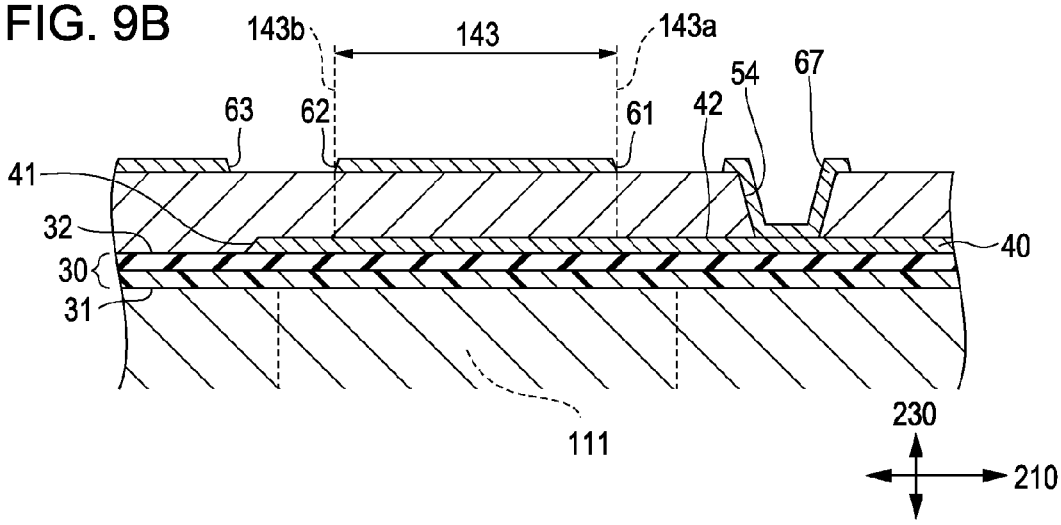

Next, as shown in FIG. 9B, the conductive layer 60*b* is patterned in the desired shape by etching and the second conductive layer 60 is formed. As shown in FIG. 9B, in the patterning process of the conductive layer 60*b*, the conductive layer 60*b* is patterned within the area that overlap at least the area 111 so as to overlap a portion of the first conductive layer 40, to overlap the first conductive layer 40 in the second direction 220 and to cover at least a portion of the piezoelectric material layer 50 in the first direction 210 as seen from the third direction 230. Also, in the patterning process of the conductive layer 60*b*, the conductive layer 60*b* is patterned so as to overlap a plurality of the first conductive layers 40 as seen from the third direction 230. Furthermore, as shown in FIGS. 4A and 4C, in the patterning process of the conductive layer 60*b*, the conductive layer 60*b* is patterned so that the second conductive layer 60 has the extension portions 65*a* and 65*b* that extend to both sides of the first direction 210 in at least a portion of the area that is sandwiched between adjacent the first conductive layers 40 as seen from the third direction 230.

In addition, the second conductive layer 60 is formed continuously so as to cover a plurality of the piezoelectric material layer 50 respectively. Accordingly, if the second conductive layer 60 is connected to the common electrode for example, through a wiring or the like (not shown), the second conductive layer 60 can be used as the common upper electrode of the piezoelectric element 100. In addition, detailed constitution of the second conductive layer 60 is omitted since it is described above. As described above, the second conductive layer 60 is patterned and the end portion 61 and the end portion 62 are arranged, so that the piezoelectric material layer 50 that corresponds the overlap area 143 can be defined on the upper surface 42 of the first conductive layer 40.

As shown in FIG. 9B, in the patterning process of the second conductive layer 60, the second conductive layer 60 may be patterned so that the conductive layer 60*b* covers at least the opening portion 54. As a result, the conductive layer 60*b* that is formed on the upper side of the opening portion 54 is not removed so that the third conductive layer 67 may be formed. Accordingly, for example, in a case where exposing process and developing process are preformed and then the resist film is formed after resist is coated, organic alkali developer, organic stripper, cleaner and the like are used. Thus, the conductive layer 60*b* that is formed on the upper side of the opening portion 54 is not removed (in other words, the third conductive layer 67 is formed) so that the surface of the first conductive layer 40 within the opening portion 54 has no possibility of overetching. Also, after etching, the exposed portion of the first conductive layer 40 within the opening portion 54 is aged by the organic stripper, cleaner and the like so that the portion is prevented from being the chemical damage. In the manufacturing method according to the embodiment, the third conductive layer 67 is not essential constitution and the conductive layer 60*b* may be removed in the opening portion 54, and the third conductive layer 67 may not be formed.

Figure 10:
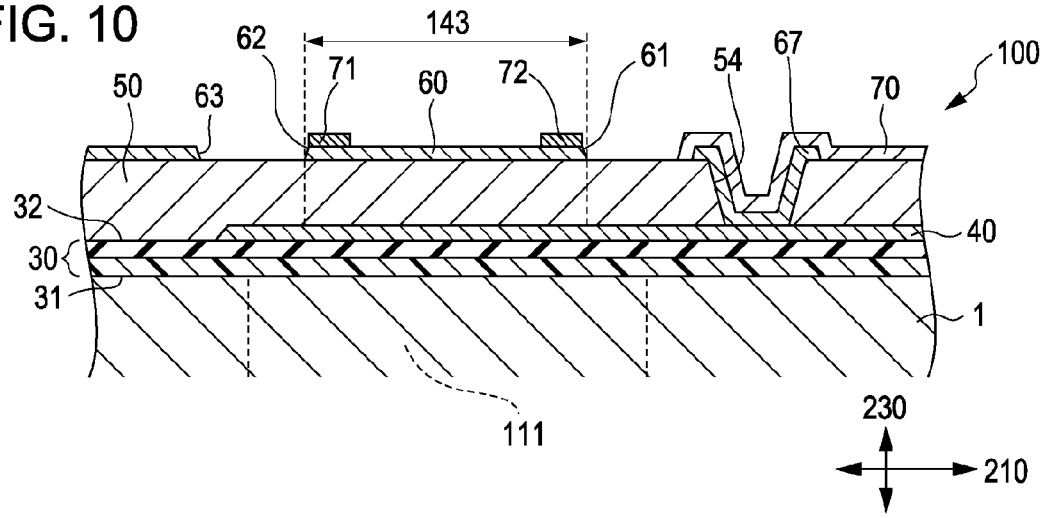
FIG. 10 is cross sectional view describing the manufacturing method of the liquid ejecting head according to the second embodiment.

Next, as shown in FIG. 10, the fourth conductive layer 70 is formed so as to cover at least the opening portion 54. If the third conductive layer 67 is formed, the fourth conductive layer 70 may be formed so as to electrically connect to the third conductive layer 67. At this time, as shown in FIG. 10, when the fourth conductive layer 70 is patterned, the first solid layer 71 and the second solid layer 72 may be simultaneously formed so as to arrange in the desired position. The fourth conductive layer 70, the first solid layer 71 and the second solid layer 72 may be formed by known film forming technique. For example, gold (Au), nickel-chrome alloy (Ni—Cr) and the like are laminated by the sputtering method or the like so that the conductive layer (not shown) is formed and the conductive layer is etched to the desired shape so that the fourth conductive layer 70, the first solid layer 71 and the second solid layer 72 may be formed. The fourth conductive layer 70 may be connected to the outside driving circuit (not shown). In addition, detailed constitution of the first solid layer 71 and the second solid layer 72 are omitted since it is described above.

Figure 11A:
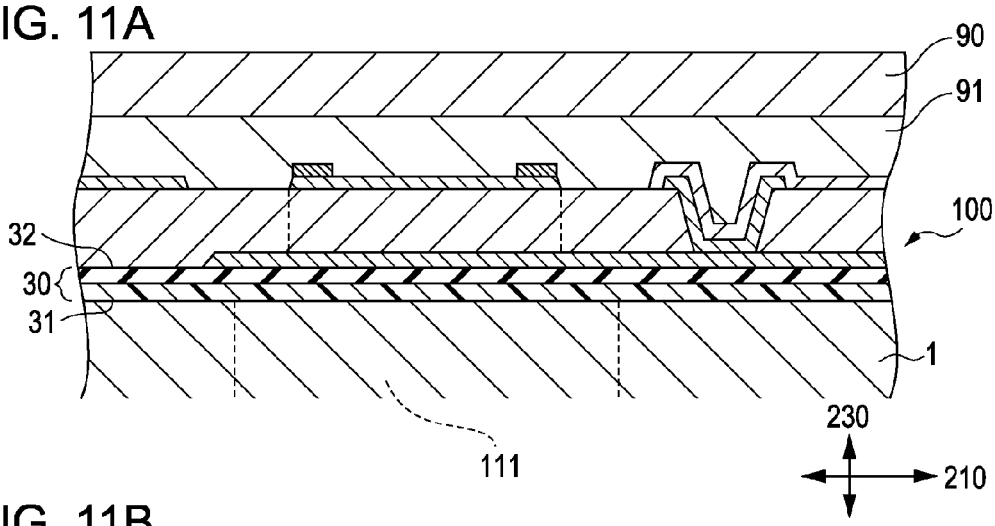
FIGS. 11A to 11C are cross sectional views describing the manufacturing method of the liquid ejecting head according to the second embodiment.
Figure 11B:
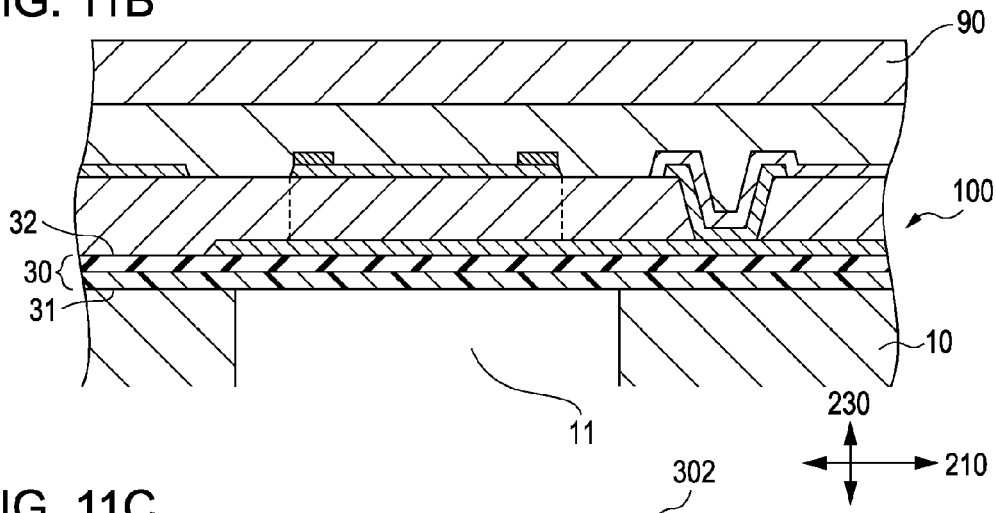
Figure 11C:
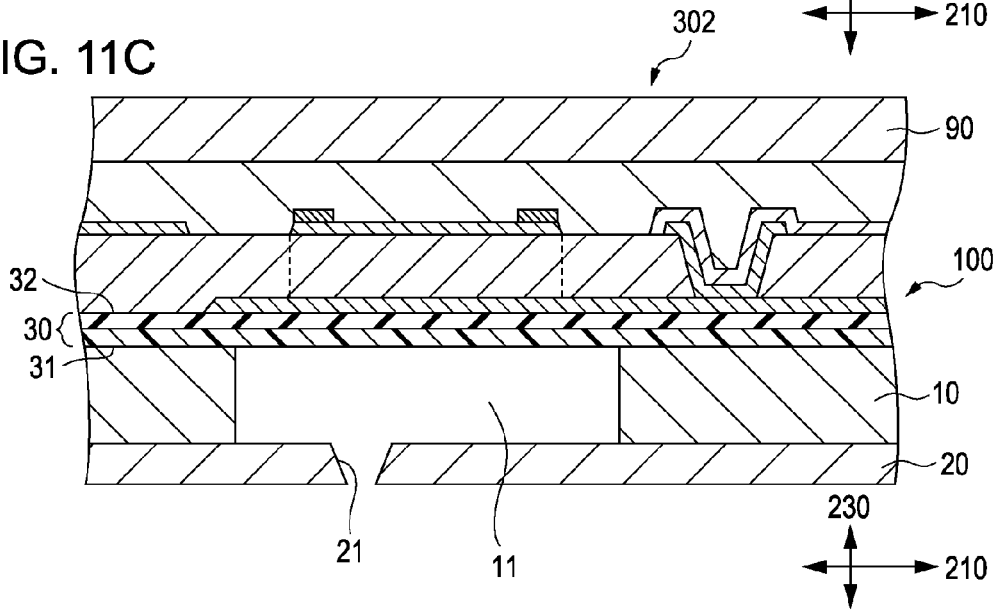

As shown in FIG. 11A, the sealing plate 90 where the sealing area 91 is formed is loaded from the upper side of the piezoelectric element 100. Here, the piezoelectric element 100 can be sealed within the sealing area 91. For example, the sealing plate 90 may seal the piezoelectric element 100 with the adhesive. Next, as shown in FIG. 11B, the substrate 1 is thinned to a predetermined thickness and the pressure chamber 11 and the like are partitioned. For example, the mask (not shown) is formed on a surface opposite to the surface where the vibration plate 30 is formed, etching process is performed, the pressure chamber 11 is formed, and the wall portion 12, the supply channel 13, the communicating channel 14 and the reservoir 15 are partitioned (not shown) so that the patterning is performed in a desired shape with respect to the substrate 1 having a predetermined thickness. Thus, the pressure chamber substrate 10 that has the pressure chamber 11 lower side of the vibration plate 30 can be formed. As shown in FIG. 11C, the nozzle plate 20 that has the nozzle hole 21 is adhered at a predetermined position for example, by the adhesive after the pressure chamber 11 is formed. Accordingly, the nozzle hole 21 communicates with the pressure chamber 11.

The liquid ejecting head 302 according to the second embodiment can be manufactured by any method that is described above. Also, as described above, the manufacturing method of the liquid ejecting head 302 according to the second embodiment is not limited to the above described manufacturing method and the pressure chamber substrate 10 and the nozzle plate 20 may be integrally formed by using the electroforming method.

2. Liquid Ejecting Apparatus

Figure 12:
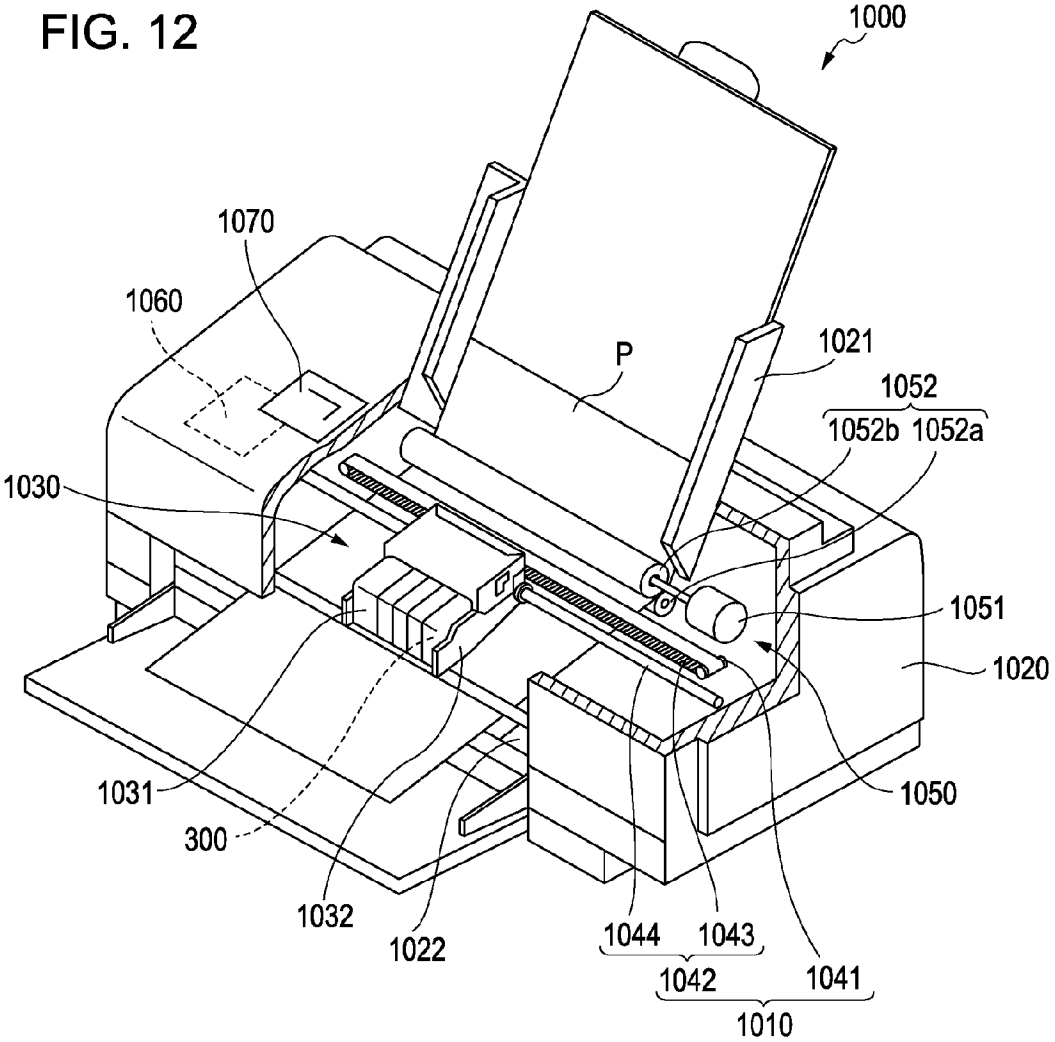
FIG. 12 is a perspective view schematically illustrating the liquid ejecting apparatus according to the embodiment.

Next, the liquid ejecting apparatus according to the embodiment is described below. A liquid ejecting apparatus 1000 according to the embodiment has the liquid ejecting head 300 according to the first embodiment. Here, description will be given as a case where the liquid ejecting apparatus 1000 according to the embodiment is the ink jet printer. FIG. 12 is a perspective view schematically illustrating the liquid ejecting apparatus 1000 according to the embodiment.

The liquid ejecting apparatus 1000 includes a head unit 1030, a driving portion 1010 and the controller 1060. In addition, the liquid ejecting apparatus 1000 may includes an apparatus main body 1020, a paper supply portion 1050, a tray 1021 that provides the recording paper P, an eject opening 1022 that ejects the recording paper P and an operation panel 1070 that is arranged on the upper surface of the apparatus main body 1020.

For example, the head unit 1030 has the ink jet type recording head (hereinafter, also simply refers to as "head") that constitutes of the above described liquid ejecting head 300. Furthermore, the head unit 1030 includes an ink cartridge 1031 that supplies the ink to the head and a transporting portion (a carriage) 1032 that loads the head and the ink cartridge 1031.

The driving portion 1010 can reciprocates the head unit 1030. The driving portion 1010 has a carriage motor 1041 that is a driving source of the head unit 1030 and a reciprocating mechanism 1042 that receives the rotation of the carriage motor 1041 and reciprocates the head unit 1030.

The reciprocating mechanism 1042 includes a carriage guide shaft 1044 of which both ends are supported at a frame (not shown) and a timing belt 1043 that is extended parallel with the carriage guide shaft 1044. The carriage guide shaft 1044 supports the carriage 1032 so that the carriage 1032 can reciprocate freely. Furthermore, the carriage 1032 is fixed at a portion of the timing belt 1043. When the timing belt 1043 is driven by the driving of the carriage motor 1041, the head unit 1030 reciprocates as guided by the carriage guide shaft 1044. When the reciprocation movement is preformed, the ink is ejected from the head and the printing is performed toward the recording paper P.

The controller 1060 can control the head unit 1030, the driving portion 1010 and the paper supply portion 1050.

The paper supply portion 1050 can transport the recording paper P toward the head unit 1030 from the tray 1021. The paper supply portion 1050 includes a paper supply motor 1051 that is a driving source thereof and a paper supply roller 1052 that is rotated by the driving of the paper supply motor 1051. The paper supply roller 1052 includes a driven roller 1052*a* and a driving roller 1052*b* that are faced to each other in the upper and the lower portions between the transport passage of the recording paper P. The driving roller 1052*b* is connected to the paper supply motor 1051. When the paper supply portion 1050 is driven by the controller 1060, the recording paper P transports so as to pass through the lower side of the head unit 1030.

The head unit 1030, the driving portion 1010, the controller 1060 and the paper supply portion 1050 are provided within the apparatus main body 1020.

The liquid ejecting apparatus 1000 can have the liquid ejecting head 300 having enhanced durability according to the first embodiment. Thus, the liquid ejecting apparatus 1000 having enhanced durability can be obtained.

In addition, the liquid ejecting apparatus 1000 may be constituted as using the liquid ejecting head 302 according to the second embodiment and the liquid ejecting head according to the modified embodiment. Even in this case, the liquid ejecting apparatus 1000 having enhanced durability can be obtained by the same reason that is described above.

In addition, in the above described embodiment, description has been given in a case where the liquid ejecting apparatus 1000 is the ink jet printer, however the liquid ejecting apparatus 1000 according to the invention can be also used as an industrial liquid ejecting apparatus. In this case, as a liquid (liquid phase material) that is ejected, the liquid can be used, wherein the liquid includes various kinds of functional materials of which viscosity is adjusted properly by solvent or dispersed medium, or includes metal flake and the like.

In addition, the embodiments and the modified embodiments described below are made for explaining examples of the invention, and the invention is not limited to them. For example, each of the embodiments and each of the modified embodiments can be properly combined in plurality.

The invention is not limited to the embodiments ascribed above and various modifications can be made. For example, the invention includes substantially the same constitution (for example, function, method and result thereof are the same constitutions or object and effect thereof are the same constitutions) as described in the embodiments. In addition, the invention includes constitutions that substitute non-essential portions of the constitutions that are described in the embodiments. In addition, the invention includes constitutions that exert the same functional effect and constitutions that can obtain the same object as the constitutions of above described embodiments. The invention also includes constitutions in which known technique is added to constitutions of above described embodiments.

What is claimed is:

1. A liquid ejecting head comprising:

a pressure chamber substrate where a plurality of pressure chambers that communicates with nozzle hole respectively is provided; and a piezoelectric element including a first conductive layer, a piezoelectric material layer and a second conductive layer which are provided in this order toward upper side of the pressure chamber substrate;

wherein the piezoelectric element has an overlap area that overlaps the pressure chamber, the first conductive layer, the piezoelectric material layer and the second conductive layer as seen from a plan view, wherein the second conductive layers overlap a plurality of the pressure chambers and are provided continuously as seen from the plan view, wherein, the first conductive layer is provided in each of the overlap areas in which a first direction is a longitudinal direction of the first conductive layer and a second direction that is orthogonal to the first direction is lateral direction of the first conductive layer, wherein, the first conductive layer has an end portion area at least one end side of the overlap area in the first direction, and wherein, a width of the end portion area gets narrower in the second direction as the end portion area directs to the end of the first direction.

2. The liquid ejecting head according to claim 1, wherein the width of the end portion area is narrowed from both ends in the second direction as the end portion area directs to the end of the first direction.

3. A liquid ejecting apparatus comprising the liquid ejecting head according to claim 2.

4. The liquid ejecting head according to claim 1, wherein the first conductive layer has end portion areas at both ends of the overlap area in the first direction.

5. A liquid ejecting apparatus comprising the liquid ejecting head according to claim 4.

6. The liquid ejecting head according to claim 1, wherein the first conductive layer is provided such that the shape of the overlap area becomes the line symmetry as seen from the plan view.

7. A liquid ejecting apparatus comprising the liquid ejecting head according to claim 6.

8. The liquid ejecting head according to claim 1, wherein the second conductive layer has two end portions at one side and the other side of the first direction at the overlap area.

9. The liquid ejecting head according to claim 8, wherein the second conductive layer has extension portions which extend from at least a portion of an area that is sandwiched between adjacent the overlap areas in both sides of the first direction as seen from the plan view.

10. A liquid ejecting apparatus comprising the liquid ejecting head according to claim 9.

11. A liquid ejecting apparatus comprising the liquid ejecting head according to claim 8.

12. The liquid ejecting head according to claim 1, further including:

a first solid layer and a second solid layer that are provided on the second conductive layer, the first solid layer is provided so as to overlap the overlap area at one end side of the overlap area in the first direction as seen from the plan view, and the second solid layer is provided so as to overlap the overlap area at the other end side of the overlap area in the first direction as seen from the plan view.

13. A liquid ejecting apparatus comprising the liquid ejecting head according to claim 12.

14. A liquid ejecting apparatus comprising the liquid ejecting head according to claim 1.

* * * * *